US011608704B2

(12) United States Patent
Jacob

(10) Patent No.: US 11,608,704 B2
(45) Date of Patent: Mar. 21, 2023

(54) METHOD AND APPARATUS FOR A JOINT-LOCKING PLUG

(71) Applicant: Gregoire Max Jacob, Houston, TX (US)

(72) Inventor: Gregoire Max Jacob, Houston, TX (US)

(73) Assignee: SOLGIX, INC, Houston, TX (US)

( * ) Notice: Subject to any disclaimer, the term of this patent is extended or adjusted under 35 U.S.C. 154(b) by 0 days.

(21) Appl. No.: 17/727,379

(22) Filed: Apr. 22, 2022

(65) Prior Publication Data

US 2022/0341282 A1 Oct. 27, 2022

Related U.S. Application Data

(60) Provisional application No. 63/179,540, filed on Apr. 26, 2021.

(51) Int. Cl.
*E21B 33/124* (2006.01)
*E21B 34/14* (2006.01)

(52) U.S. Cl.
CPC ..... *E21B 33/1246* (2013.01); *E21B 34/14* (2013.01); *E21B 2200/05* (2020.05)

(58) Field of Classification Search
CPC ... E21B 33/1246; E21B 34/14; E21B 2200/05
See application file for complete search history.

(56) References Cited

U.S. PATENT DOCUMENTS 2,331,532 A 8/1940 Bassinger
5,131,468 A 7/1992 Lane et al.
5,819,846 A 10/1998 Bolt, Jr.
5,984,007 A 11/1999 Yuan et al.
6,220,349 B1 4/2001 Vargus et al.
6,394,180 B1 5/2002 Berscheidt
7,475,736 B2 1/2009 Lehr et al.
7,510,018 B2 3/2009 Williamson
8,579,024 B2 11/2013 Mailand et al.
8,684,096 B2 4/2014 Harris et al.
8,887,818 B1 11/2014 Carr et al.
8,997,859 B1 4/2015 Ackermann
9,027,655 B2 5/2015 Xu et al.
9,027,659 B2 5/2015 Martinez et al.
9,062,543 B1 6/2015 Snider et al.
9,080,403 B2 7/2015 Xu et al.
9,284,803 B2 3/2016 Stone et al.
9,309,733 B2 4/2016 Xu et al.
9,316,084 B2 4/2016 Carter et al.
(Continued)

*Primary Examiner* — Yong-Suk (Philip) Ro

(74) *Attorney, Agent, or Firm* — Innovation and Patent IP Houston, LLC

(57) ABSTRACT

A joint-locking plug is deployed next to tubing joint connection gap. The actuation of the joint-locking plug allows expanding a gripping portion which includes a protrusion section. The contact between the protrusion section of the gripping portion with the inner surface of the tubing string allows to end the actuation. Due to the bi-stable slips, the pumping of an actuated plug will engage the protrusion section of the gripping portion inside the joint connection gap, and provide the locking of the gripping portion of the plug. By further applying a fluid pressure, the anchoring section of the gripping portion gets engaged and further set the plug in place, allowing to perform further operation with the plug.

18 Claims, 17 Drawing Sheets

(56) References Cited

U.S. PATENT DOCUMENTS

| | | | |
|---|---|---|---|
| 9,316,086 | B2 | 4/2016 | Van Lue |
| 9,382,787 | B2 | 7/2016 | Naedler |
| 9,732,579 | B2 | 8/2017 | Hiorth et al. |
| 9,752,407 | B2 | 9/2017 | Jacob |
| 9,835,003 | B2 | 12/2017 | Harris |
| 9,976,381 | B2 | 5/2018 | Martin et al. |
| 9,988,867 | B2 | 6/2018 | Jacob et al. |
| 10,066,453 | B2 | 9/2018 | Silva |
| 10,385,651 | B2 | 8/2019 | Smith et al. |
| 10,408,012 | B2 | 9/2019 | Martin et al. |
| 10,472,927 | B2 | 11/2019 | Marcin et al. |
| 10,508,526 | B2 | 12/2019 | Ring |
| 10,648,275 | B2 | 5/2020 | Dirocco |
| 10,662,732 | B2 | 5/2020 | Frazier |
| 10,724,311 | B2 | 7/2020 | Parekh et al. |
| 10,794,142 | B2 | 10/2020 | Stone et al. |
| 11,002,104 | B2 | 5/2021 | Wolf et al. |
| 11,021,927 | B2 | 6/2021 | Hiorth |
| 11,047,186 | B2 | 6/2021 | Ng et al. |
| 11,072,991 | B2 | 7/2021 | Martin et al. |
| 11,125,045 | B2 | 9/2021 | Hern et al. |
| 11,274,525 | B2 | 3/2022 | Kratochvil |
| 11,396,787 | B2 | 7/2022 | Kellner et al. |
| 11,408,245 | B2 | 8/2022 | Dudzinski |
| 11,428,089 | B2 | 8/2022 | Winkler et al. |
| 11,434,717 | B2 | 9/2022 | Jacob |
| 11,492,867 | B2 | 11/2022 | Yuan et al. |
| 2015/0129239 | A1* | 5/2015 | Richard ..... E21B 33/128 166/195 |
| 2016/0047195 | A1 | 2/2016 | Snider |
| 2016/0186511 | A1 | 6/2016 | Coronado |
| 2016/0186514 | A1* | 6/2016 | King ..... E21B 43/26 166/250.01 |
| 2018/0171737 | A1* | 6/2018 | Xu ..... E21B 34/10 |
| 2018/0266206 | A1* | 9/2018 | Berscheidt ..... E21B 33/1294 |
| 2021/0246759 | A1* | 8/2021 | Cao ..... E21B 34/142 |
| 2021/0310338 | A1 | 10/2021 | Turley et al. |
| 2021/0372230 | A1* | 12/2021 | Palmer ..... E21B 34/14 |
| 2022/0127948 | A1* | 4/2022 | Helms ..... E21B 47/06 |
| 2022/0259962 | A1* | 8/2022 | Lo ..... E21B 33/1294 |

* cited by examiner

METHOD AND APPARATUS FOR A JOINT-LOCKING PLUG

BACKGROUND

This disclosure relates generally to methods and apparatus for providing downhole plugs able to lock within a tubing joint. This disclosure relates more particularly to methods and apparatus for providing a joint-locking plug with bi-stable slips able to lock and set within the gap formed by the assembly of tubing joints.

Prior art includes plugs setting inside tubing string, whereby slips are radially expanded with a setting tool, and whereby the position of the plug is determined by the position of the expanded slips.

The prior art typically requires a high setting force to allow anchoring and penetrating the inner surface of the tubing string. A typical drawback of slips not fully anchored is slipping plugs when under pressure differential. This can cause issue in multi-stage stimulation operation where the efficiency of a stage with a slipping plug is very low, as the pumped fluid pressure is not directed to the dedicated perforation but is dissipated in the volume of the prior stages.

The disclosed invention allows to use the presence of joint gaps to enhance the setting and locking of the plug. A typical casing string or tubing string include multiple joints, and those joints are connected to each other's with a connection which generally keep a longitudinal gap between two joints. Depending on the connection type, a collar is often added to connect two subsequent joints. The joint gap, for a given casing type, such as API Buttress, is typically regular and repeatable at each casing joint, i.e. every 30 to 40 feet [10 to 13 m], along the globality of the tubing string. This gives many opportunities to select joint gaps with a typical tubing string between 10,000 and 30,000 feet [3,300 to 10,000 m].

The disclose invention allows to set the plug in two stages, whereby the first stage is an actuation which pre-position the slips and the plug uphole of a joint gap, and whereby the second stage allows locking the plug inside the joint gap. One advantage is the necessity of less force for the first stage of actuation, which would be done by a setting tool conveyed on toolstring. This allows to use different setting tool type, which can provide 5 to 10 times less force. The resulting advantage is a cost advantage and energy saving for a less powerful setting tool.

One other advantage resides in the locking of the slips within the joint gap. This allows to better anchor the plug at predetermined position, whereby the plug has less possibility to slip, and whereby the force transmitted during the pressure differential phase can be higher, using the same or shorter plug. The metal-to-metal sealing can also be enhanced with this method, as the force transmitted through the plug with a pressure differential can be better focused towards a plastic deformable sealing ring.

FIGS. 1 and 2 refer to one environment example in which the methods and apparatus for providing a plug with an untethered object inside a tubing string containing well fluid described herein may be implemented and used.

FIG. 1 illustrates a typical cross-section of an underground section dedicated to a cased-hole operation. The type of operation is often designated as Multi-Stage-Stimulation, as similar operations are repeatedly performed inside a tubing string in order to stimulate the wellbore area.

The wellbore may have a cased section, represented with tubing string 1. The tubing string contains typically several sections from the surface 11 until the well end. The tubing string represented schematically includes a vertical and horizontal section. The entire tubing string contains a well fluid 2, which can be pumped from surface, such as water, gel, brine, acid, and also coming from downhole formation such as produced fluids, like water and hydrocarbons.

The tubing string 1 can be partially or fully cemented, referred to as cemented stimulation, or partially or fully free within the borehole, referred to as open-hole stimulation. Typically, an open-hole stimulation will include temporary or permanent section isolation between the formation and the inside of the tubing string.

The bottom section of FIG. 1 illustrates several stimulation stages starting from well end. In this particular well embodiment, at least stages 14*a*, 14*b*, 14*c* have been stimulated and isolated from each other. The stimulation is represented with fluid penetration inside the formation through fracturing channels 13, which are initiated from a fluid entry point inside the tubing string. This fluid entry point can typically come from perforations or sliding sleeves openings.

Each isolation includes a plugging element 3 with its untethered object 5, represented as a spherical ball as one example.

The stimulation and isolation are typically sequential from the well end. At the end of stage 14*c*, after its stimulation 13, another isolation and stimulation may be performed in the tubing string 1.

FIG. 2 depicts a sequential step of FIG. 1 with the preparation of subsequent stage 14*d*. In this representation, a toolstring 10 is conveyed via a cable or wireline 15, which is controlled by a surface unit 16. Other conveyance methods may include tubing conveyed toolstring, coiled tubing or tractoring. Along with a cable, a combination of gravity, tractoring and pump-down may be used to bring the toolstring 10 to the desired position inside the tubing string 1. In FIG. 2, the toolstring 10 conveys an unset plug 17, dedicated to isolating stage 14*c* from stage 14*d*.

BRIEF DESCRIPTION OF THE DRAWINGS

For a more detailed description of the embodiments of the disclosure, reference will now be made to the accompanying drawings.

DETAILED DESCRIPTION OF THE INVENTION

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

The description of the apparatus and methods from FIG. 3 to FIG. 25 are mainly related to a plug with bi-stable slips and locking within a tubing joint. FIG. 3 to FIG. 25 include also the description of the apparatus and methods for the fluid activated shifting tool. Additional description of the fluid activated shifting tool will be made for the FIG. 26 to FIG. 32, without using a plug with bistable slips.

Figure 3:
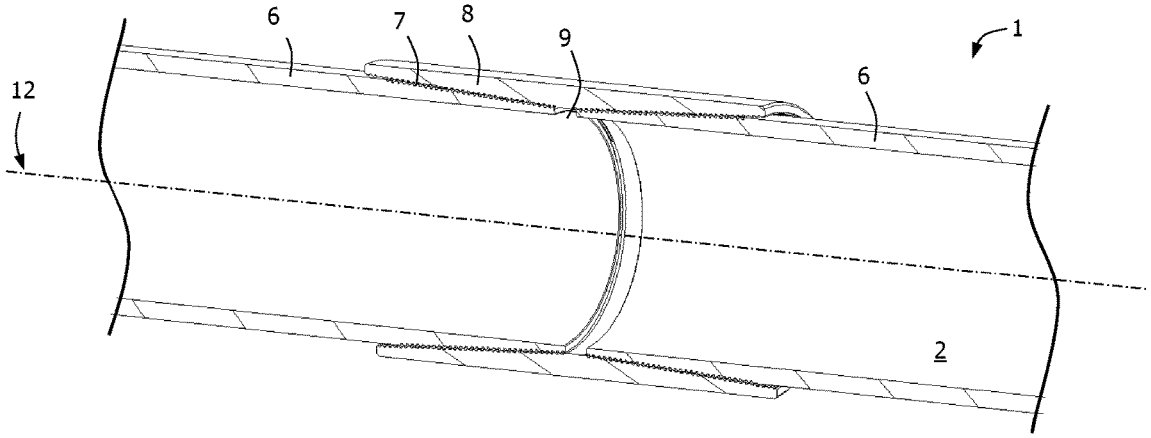
FIG. 3 is a close-up isometric cross-section view of a tubing connection, including joints, collar and transition gap.

FIG. 3 represents an isometric cross-section detailed view of a section of the tubing string 1. The represented section includes a junction between several casing or tubing joints, as it would typically be present within the wellbore downhole.

A typical casing string or tubing string may be assembled from several casing or tubing joints 6. Each tubing or casing joint 6 may be ended with a pin threaded section 7, represented as a male connection. A casing joint 6 may have a cylindrical shape, with a longitudinal length around thirty to forty feet [10-13 m], diameters between one inch and twenty inches [25-500 mm], and a wall thickness between 0.1 in and 1 inch [2-25 mm]. Additional shorter joints may be used in various situations in order to position a specific section, such as a sliding sleeve section, a diameter transition, a dogleg transition, a branch transition, within the casing or tubing string. Joints 6 are typically assembled piece by piece from surface as an overall casing string or tubing string 1, and inserted inside the well bore or inside a previously installed larger diameter tubing or casing.

The junction of two casing or tubing strings 6 may be realized with a collar 8. The collar 8 may be threaded as a box, or female thread, allowing the connection of two casing or tubing strings 6 on each extremity. Other connection, such as twist and lock, press fitting may be used to connect a collar 8 with a joint 6 on each side.

The tubing string or casing string may further be cemented or secured at several holding points within the wellbore, thanks to expandable packers, liner hangers, or in direct contact with the wellbore wall.

At the junction of two casing joints or tubing joints 6, a transition gap 9 may be present. The transition gap 9 may represent an annular cylindrical gap, formed longitudinally by the edge of the two joints 6, and cylindrically on the external diameter by the inner wall of the collar 8. The cylindrical dimensions of the transition gap 9 may vary depending on joint size, weight, connection type, installation type. For example, connection type may have a normed dimension and dedicated name, such as API Buttress or BTC. Various other proprietary casing joint or tubing joint connections exist within the industry, sometimes referred as premium connections, in order to maximize the characteristics of the connection, such as gas tightness, pressure differential, axial and radial load. The application relative to the plug with bi-stable slips may lock inside transition gap 9, having a longitudinal length within 0.01 to 10 inch [0.25 to 254 mm] and a radial length within 0.01 to 1 inch [0.25 to 25.4 mm].

Item 12 would represent an axis reference for the cylindrical geometries present within the wellbore, the toolstring or the plug.

Figure 4:
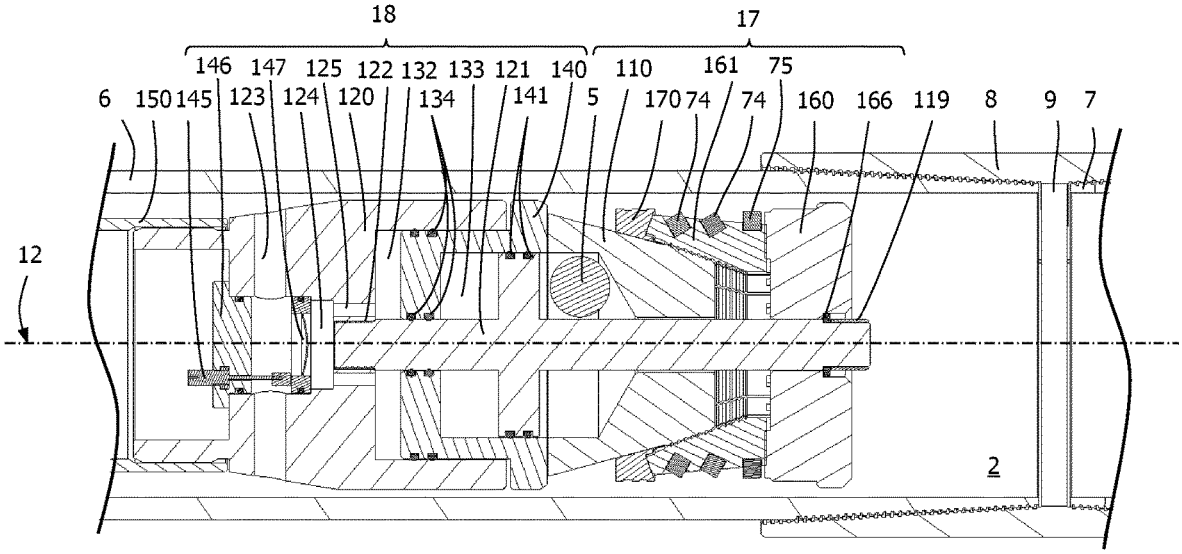
FIG. 4 is a cross-section view of a plug with bi-stable slips, on a fluid activated setting tool, inside a tubing string.
Figure 5:
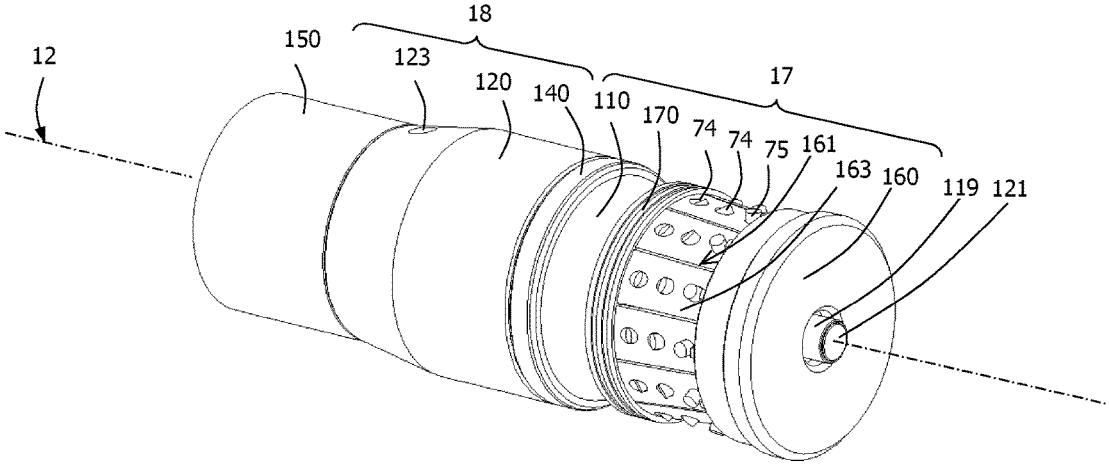
FIG. 5 is an isometric view of a plug with bi-stable slips, on a fluid activated setting tool.
Figure 6:
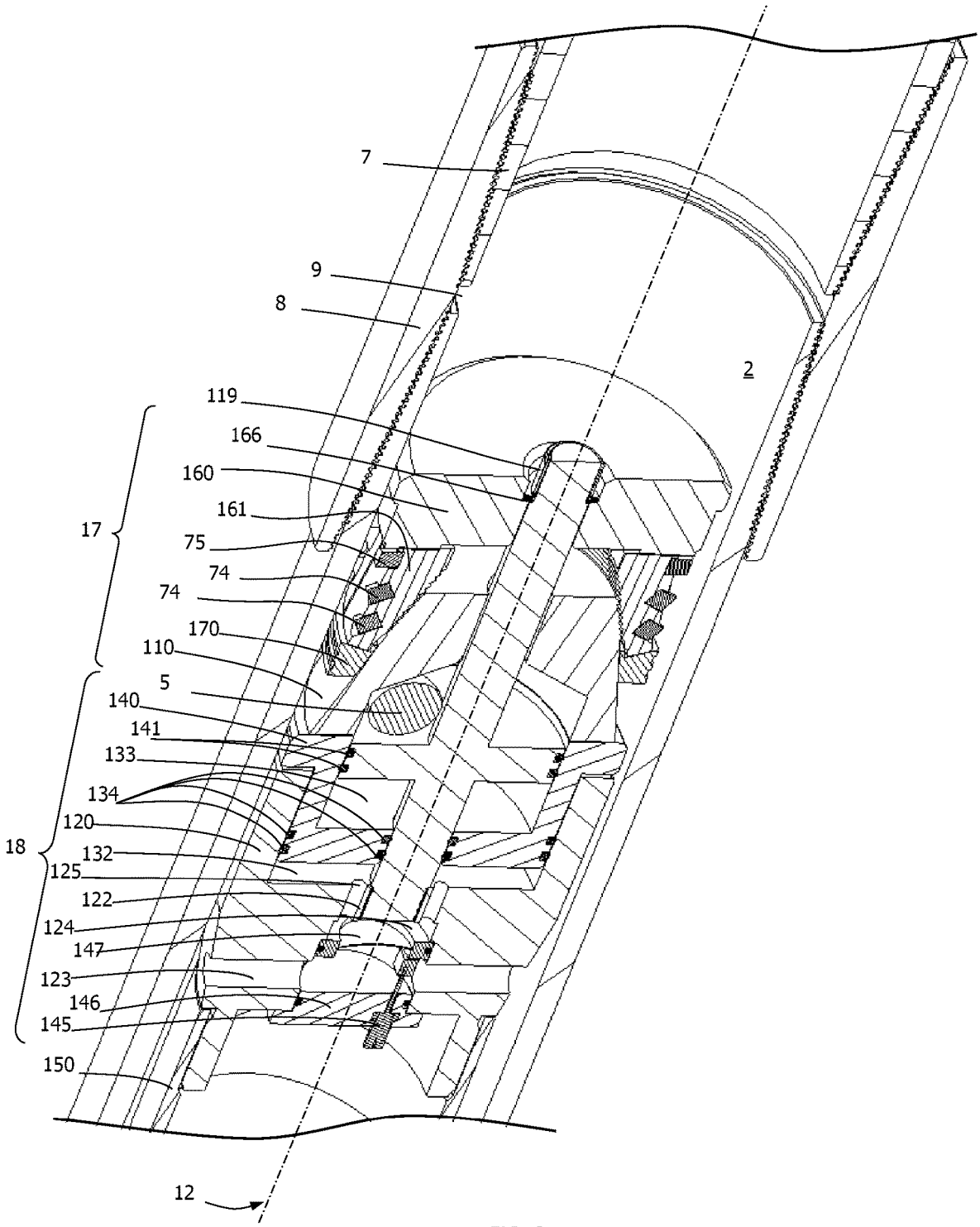
FIG. 6 is an isometric cross-section view of a plug with bi-stable slips, on a fluid activated setting tool, inside a tubing string.

FIGS. 4 to 6 represent different views of a plug 17 with bi-stable slips, in an unset or run-in-hole position, along a fluid activated shifting or setting tool 18.

FIG. 4 depicts a cross-section view of a toolstring including a plug 17 with bi-stable slips, and a fluid activated shifting or setting tool 18. The toolstring is represented inside a tubing joint 6 next to a transition gap 9, formed by two joints 6 and a collar 8, along a cylindrical reference axis 12.

As represented in FIGS. 4 to 6, the plug 17 may include following main parts:

a locking ring 110, a gripping portion 161. The gripping portion 161 may include several slips 163, disposed radially. On their external surface, each slip 163 may include a gripping device 74, such as buttons or teeth, in order to grip or penetrate the inner surface of the tubing joints 6. The gripping portion 161 may include also a protrusion 75, in order to contact the casing or tubing joints 6. The protrusion 75 can have the form of a button or an extension, which is not necessarily dedicated to penetrate the inner surface of the tubing joint 6, a sealing portion 170, a back-pushing ring 160, a shearing device 166, such as shear ring or shear screws, or combination thereof.

Further views and details of the plug 17, the locking ring 110 and gripping portion 161 will be represented in FIGS. 22 to 25.

In addition, the plug 17 may carry an untethered object 5, often referred as ball-in-place. The untethered object 5 may also be dropped from surface, often referred as ball-drop, and further depicted in FIGS. 31 and 32. The untethered object 5 may have the form a ball, a pill, a ball section or a dart. Alternatively, a flapper valve may be placed, in an open position, inside the locking ring 110, with the possibility to be closed when the rod 121 is no more present. The function of the flapper valve would be similar to the untethered object 5 within the locking ring 110, once the rod 110 is no present. The function of the flapper valve or untethered object 5 may be to stop or divert the flow of well fluid 2 coming from uphole and being pumped or pushed towards downhole. The function might be seen as a one-way valve, diverting well fluid flow coming from uphole, and letting pass a well fluid flow coming from downhole, such as a flowback.

All parts of the plug 17, such as the sealing portion 170, the gripping portion 161, the locking ring 110, the back-pushing ring 160, the untethered object 5, may be built out of a combination of dissolvable materials, whether plastics or metals. Dissolvable materials have the capacity to react with surrounding well fluid 2 and degrades in smaller particles over time. After a period of preferably a few hours to a few months, most or all the dissolvable components have degraded to particles remaining in the well fluid 2.

The plug 17 may be inserted and secured on a setting tool 18, represented as a fluid activated shifting tool.

The setting tool 18 may include a fixed body 120 together with a rod 121. The two parts 120 and 121 are represented separated for practical or manufacturing reason, though both parts constitute the same mechanical entity. As represented, a connection 122 between the fixed body 120 and the rod 121 may be a threaded, welded, presses or pined connection.

Figure 1:
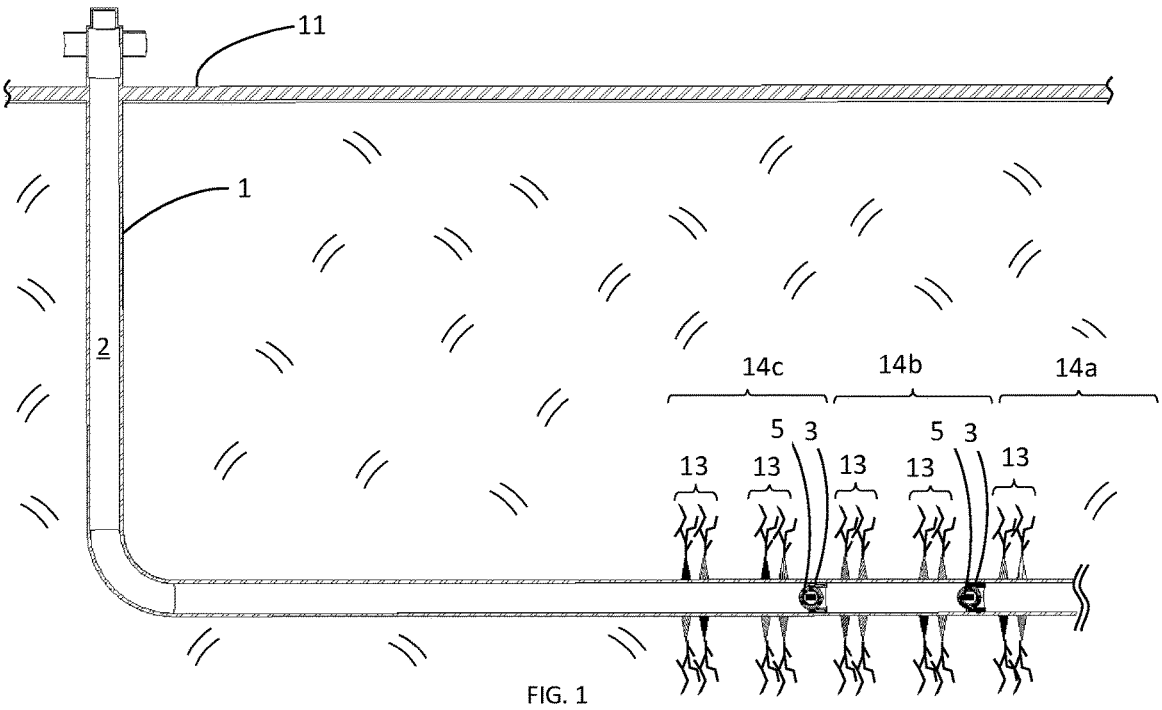
FIG. 1 is a wellbore cross-section view of typical Multi-Stage-Stimulation operation ongoing, with three stages completed.
Figure 2:
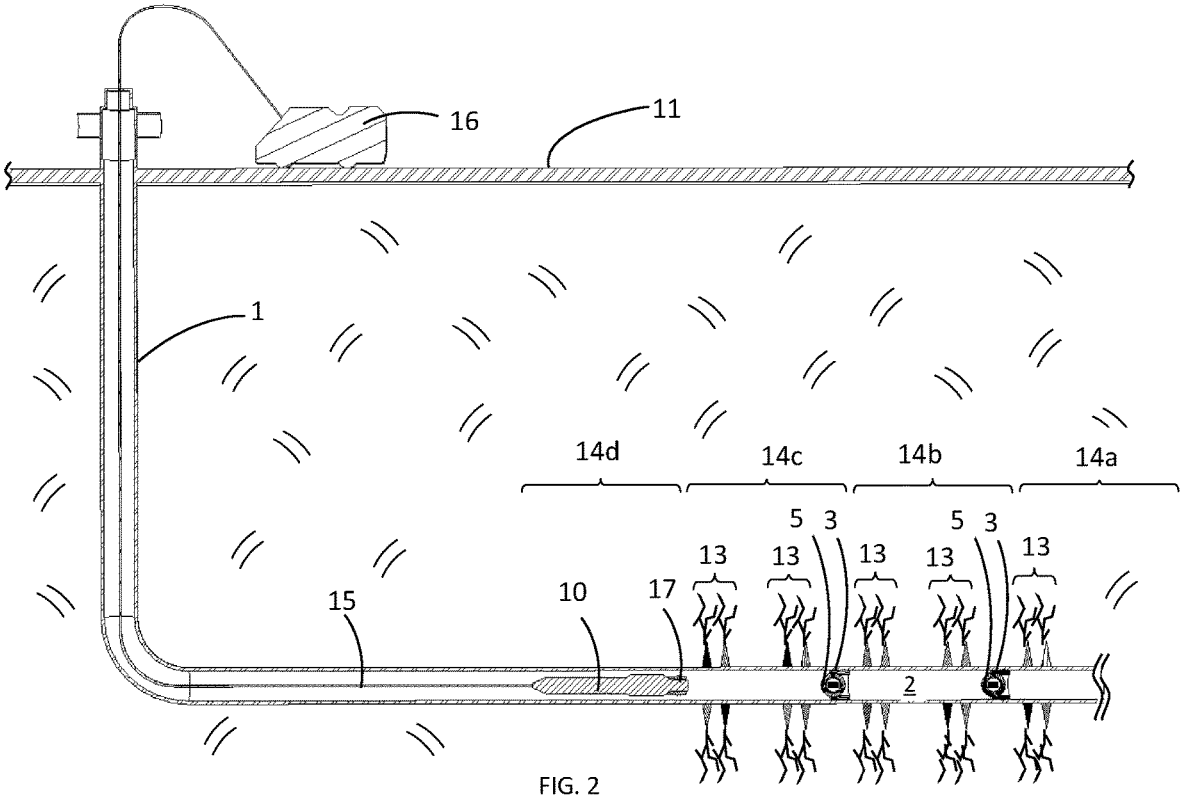
FIG. 2 is a wellbore cross-section view of toolstring conveyance to install the third isolation device for the fourth stage.

The fixed body 120 may be connected to the remaining of the toolstring through a toolstring sleeve 150. The toolstring sleeve 150 symbolizes a portion of an overall toolstring, as represented with item 10 in FIG. 2. The remaining of the toolstring 10 may include a gun or perforating section, a measurement section, a power and control section, and a communication section. Typical measurements realized by the toolstring 10 may include the CCL [Casing Collar Locator], the Gamma Ray, the Pressure, the Temperature or the Acceleration, inside the wellbore.

The plug 17 may be secured around the rod 121, as represented with the locking ring 110 being concentric with the cylindrical end part of the rod. The back-pushing ring 160 may be concentric to the rod 121 and secured though a shearing device 166 and an end nut 119. The shearing device 166 may be a shear ring or shear screws, or combination thereof. The end nut may be screwed, pressed, pined, on the rod 121, in order to lock the translation movement of the shearing device 166, along the rod 121.

A piston 140 may slide longitudinally along axis 12 and concentric to the fixed body 120 and rod 121. On the toolstring side of the piston 140, a fluid pressure chamber 132 may be present. The fluid pressure chamber 132 may be delimited by the piston 140 and include dynamic sealing 134. The dynamic sealing 134 may provide a fluid barrier between both the piston 140 with the fixed body 120, and the piston 140 with the rod 121. Therefore, the fluid pressure chamber 132 may extend or retract longitudinally and vary its cylindrical volume with the longitudinal movement of the piston 140 relative to the fixed body 120 and rod 121.

On the opposite side of the pressure chamber 132 along the piston 140, a relief pressure chamber 133 may be present. The relief pressure chamber may typically be filled with air or an inert gas, and kept at atmospheric pressure. A dynamic seal 141 may be placed to create a fluid barrier between the moving piston 140 and the fixed rod 121.

The pressure chamber 132 may be linked to another chamber, an initial pressure chamber 124. The initial pressure chamber may have the same pressure as the pressure chamber 132, as both chambers are connected through channels 125. The channels 125 may have the form of connecting holes through the fixed mandrel 120, in order to hydraulically link the initial pressure chamber 124 and the pressure chamber 132.

A fluid entry valve 147 may create a fluid barrier to the initial pressure chamber 124 and therefore to the pressure chamber 132. The fluid entry valve 147 may have the form of a rupture disc valve, a shifting valve or flapper valve. The purpose of the fluid entry valve 147 may be to provide a temporary fluid barrier to the pressure chambers 124 and 132, with the ability to be opened by a deliberated actuation. The fluid entry valve 147 may be linked to an actuator 145, which would provide the force or power to open the fluid entry valve 147. Typically, the actuator 145 would be connected electrically to a power supply or be self-powered, with a battery for example. A signal to actuate the actuator 145 and therefore open the fluid entry valve 147, may come from surface, and for example from an addressable switch or may be programed in-situ within the tool string 10. The program to actuate the actuator 145 may include the reaching of predetermined criteria matching live sensed data such as, for example, a CCL [Casing Collar Locator] count, a fluid pressure, a signature from pre-position feature within the tubing string. Other type of actuation signal may come from a wireless communication from surface, or pressure pulse from surface.

The fluid entry valve 147 may provide a pressure fluid barrier between 0 psi and 20,000 psi [0 to 138 MPa]. After the actuation of the fluid entry valve 147 from the actuator 145, the fluid entry valve would be in an opened position, allowing fluid to circulate through the valve 147. An opened fluid entry valve would be represented as item 148 in FIG. 7. A fluid entry point 123 would be present within the fixed body 120. The fluid entry point 123 would hydraulically link the pressure from the well fluid 2 with the wall of the fluid entry valve 147. The fluid entry point 123 may be built out of channels or holes through the fixed body 120. Upon actuation of the fluid entry valve 147 and its opening, the fluid pressure from the well fluid 2 would correspond to the pressure available inside the pressure chamber 132.

A support fitting 146 may be present to hold the actuator 145 and provide a fluid barrier in the continuity with the fixed body 120. The support fitting 146 may have mainly a mounting or manufacturing function.

Figure 7:
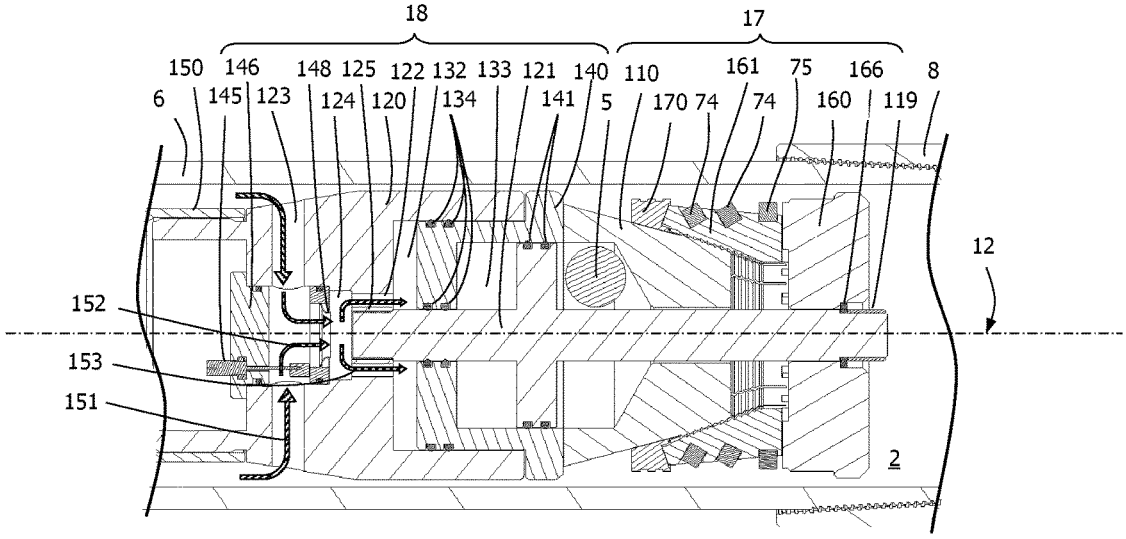
FIG. 7 is a cross-section view of a plug with bi-stable slips, on a setting tool inside a tubing string, sequential of FIG. 4, whereby the plug actuation movement is initiated with fluid.

FIG. 7 represents the fluid activated shifting tool or setting tool 18 when the fluid entry valve 147 has been actuated. In FIG. 7, the fluid entry valve in its opened position is represented as item 148. As depicted with arrow 151, a fluid flow 151 would circulate from the wellbore 2 towards the inside of the fixed body 120, through the fluid entry point 123. The fluid flow 151 would continue and penetrate through the actuated fluid entry valve 148, as represented with arrow 152. The fluid flow 152 would then enter the initial fluid pressure chamber 124, and further continue towards the fluid pressure chamber 132, through the channels 125. The fluid flow 153 is depicted with arrow 153.

Figure 8:
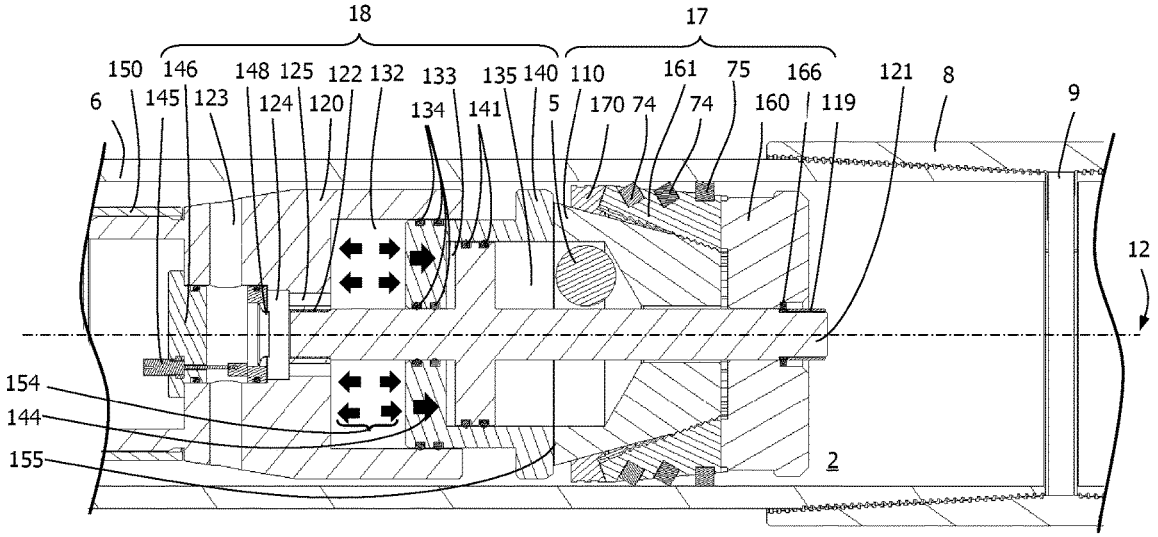
FIG. 8 is a cross-section view of a plug with bi-stable slips, on a setting tool inside a tubing string, sequential of FIG. 7, whereby the plug has been actuated and reached its radial stopping position.

FIG. 8 represents the fluid activated shifting tool, or setting tool 18 in the actuated position. As represented in FIG. 7, fluid has entered the pressure chamber 132 through the fluid entry valve 147. With the fill-up of the fluid pressure chamber 132, a fluid pressure 154 acts within the volume of the fluid pressure chamber 132. The fluid pressure 154 would act as a shifting force 144 on the piston 140, due to a pressure differential created between both sides of the piston 140, namely the pressure chamber 132 and the relief pressure chamber 133, which remain filled with air or a gas at atmospheric pressure. In more detail, the shifting force 144 may be estimated as $F_{piston}=P_{fluid}*S_{pressure}-P_{atm}*S_{relief}$. In the exposed force equilibrium, $P_{fluid}$ may be the hydrostatic pressure of well fluid 2, at the current depth of the toolstring 10, inside the wellbore 1. $S_{pressure}$ may be the surface of the piston 140 facing the main fluid pressure chamber 132, as a disc delimited with the sealing 134 diameters ID [inside diameter] and OD [outside diameter]. $P_{atm}$ would be the surface atmospheric pressure, typically around 14 psi or 1 bar. $S_{relief}$ would be the surface of the piston 140 facing the relief pressure chamber 133, as a disc delimited with the sealing 141 diameter as OD, and the smaller sealing diameter of sealing 134 as ID. Friction, leaks, or dynamic effects may affect this piston force calculation. Possibly a spring, not shown, may be added inside chamber 132 or 135 to balance the forces equilibrium, if necessary, to control the speed of the shifting of piston 140, or to provide a redressed position to the piston 140, once no pressure is acting any more.

A contact surface 155 is represented between the piston 140 and the locking ring 110. Piston shifting force 144 would be transmitted to the locking ring 110 through the contact surface 155. Considering the fixed body 120 and the rod 121 stationary compared to the tubing joint 6, and considering the shearing device 166 still intact, the back-pushing ring 160 may contact the gripping portion 161. The piston shifting force 144 would provide a longitudinal movement to the locking ring 110, along the cylindrical axis 12, compared to the rod 121 and the back-pushing ring 160. The longitudinal movement of the locking ring 110 would in turn shift longitudinally the sealing portion 170 and the gripping portion 161, along the external conical surface of the locking ring 110. Due to the external flared or conical surface shape of the locking ring, the longitudinal movement of the sealing portion 170 and gripping portion 161 would translate towards a radial expanding movement of both the sealing portion 170 and the gripping portion 161. The radial expanding movement of the gripping portion 161 may stop once the protrusion 75 would contact the inner surface of the tubing string 6. Once the protrusion 75 would contact the inner surface of the tubing string 6, the plug 17 has reached its stopping position, while the gripping devices 74 may not have yet penetrated the inner surface of the tubing string 6. The contact force of the protrusion 75 would stop the longitudinal movement of the piston 140 and, in turn, transmit the shifting force 144 towards the shearing device 166. Once the shifting force 144 may have exceeded the pre-set shear force of the shearing device 166, the shearing of the shearing device 166 may occur.

Figure 9:
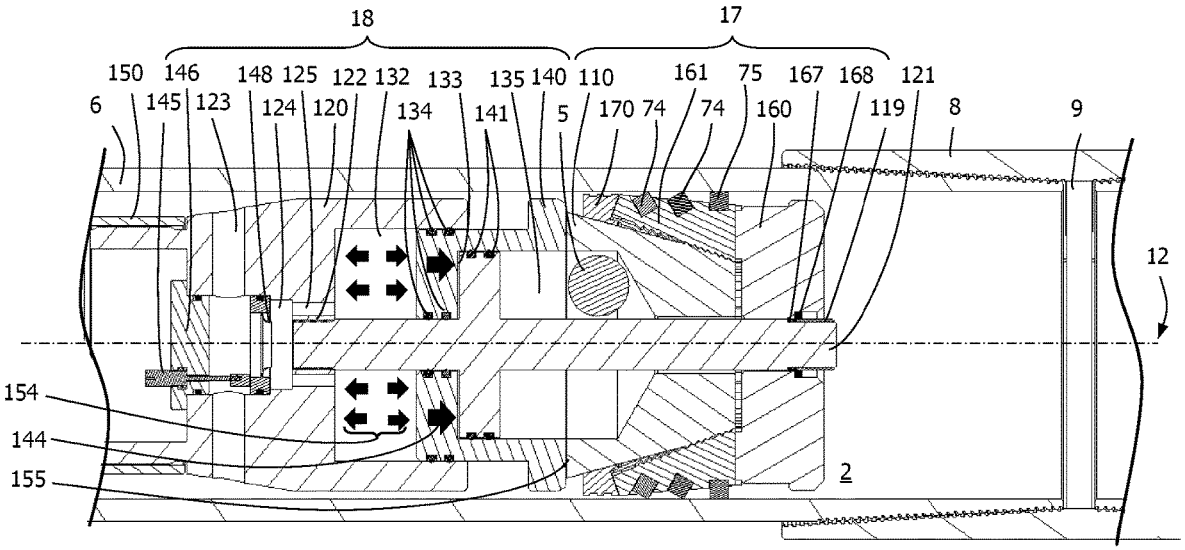
FIG. 9 is a cross-section view of the plug in its radial stopping position, on a setting tool inside a tubing string, sequential of FIG. 8, whereby the shearing device has been sheared.

FIG. 9 is a subsequent step of FIG. 8. The plug 17 is represented in its stopping position within the tubing joint 6. The shearing device 166, as represented in FIG. 8 is now sheared, between an edge of the end nut 119 and an opposite edge of the back-pushing ring 160. Two portions of the shearing device are represented in FIG. 9. A first portion 167 is linked to the rod 121. A second portion 168 is linked to the back-pushing ring 160.

In this configuration, the stopping position is determined by the contact of the protrusion 75 of the gripping portion 161. The protrusion 75 contacts the tubing string 6 inner surface.

Figure 10:
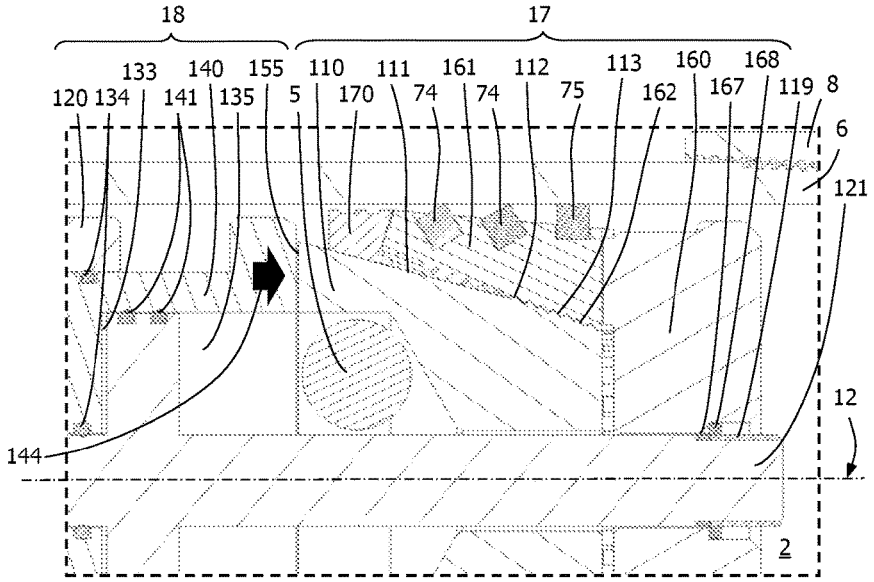
FIG. 10 is a close-up detailed view of the cross-section FIG. 9.

FIG. 10 represents a detailed view of the cross-section presented in FIG. 9. The detailed view of FIG. 10 focuses particularly on the surfaces of the locking ring 110 and gripping portion 161. The locking ring 110 may include two subsequent flared outer surfaces. A first flared outer surface with a shallow angle is represented with surface 111. A second flared outer surface with a steep angle is represented with surface 113.

A transition outer line 112 may virtually connect the shallow flared outer surface 111 and steep flared outer surface 113. The transition outer line 112 may be an edge or circular line around the outer surface of the locking ring 110. The transition outer line 112 may include a round or a chamfer to achieve this transition. Surfaces 111 and 113 may include stripping or threaded features to increase surface friction with gripping portion 161. Angles and conical features are referenced by the lead axis 12. Further details about the angles of the locking ring 110 will be described in FIG. 15 and FIG. 23.

The gripping portion 161 may include a flared inner surface 162. The flared inner surface 162 may form a conical shape with an average lead shallow conical angle. The flared inner surface 162 may have a similar lead angle as the shallow flared outer surface 113. Therefore, the gripping portion, with its individual slips 163, may have a bi-stable position regarding the locking ring 110. On a first stable position, as represented in FIG. 10, the flared inner surface 162 would contact the shallow flared outer surface 111 of the locking ring 110. The pivoting point for each individual slips 163 of the gripping portion 161 may be the transition outer line 112 of the locking ring 110.

Figure 11:
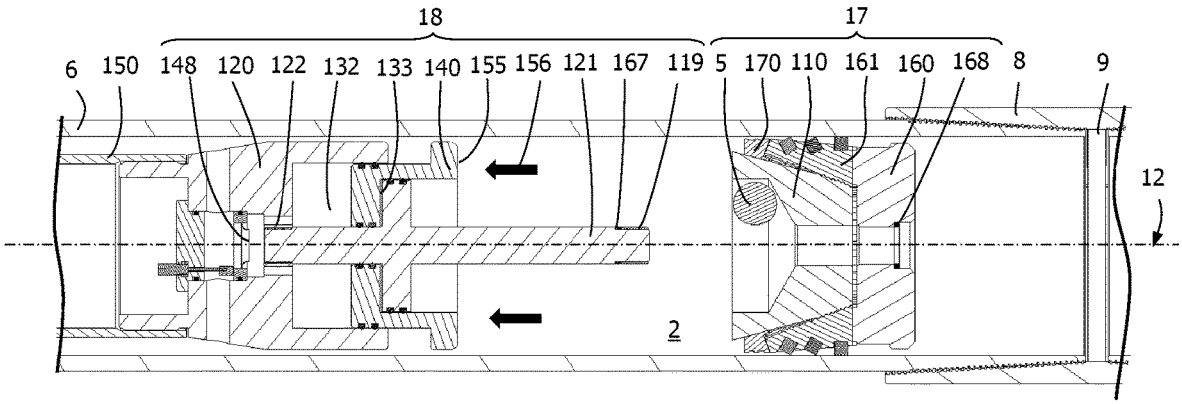
FIG. 11 is a cross-section view of the plug its radial stopping position, separated from the setting tool inside a tubing string, sequential of FIG. 9

FIG. 11 represents a subsequent step of FIGS. 9 and 10. After the plug 17 has reached its stopping position, the toolstring 10 including the setting tool portion 18 may be pulled uphole, as symbolized with movement arrow 156. Depending on toolstring 10 conveying methods, the uphole movement can be initiated by cable pulling, coiled-tubing pulling, tubing pulling, upwards tractoring, or similar. The plug 17 in its stopping position may be left in its current position relative to the tubing string 1 and within a tubing joint 6. An alternative subsequent step series to FIGS. 9 and 10 may be represented in FIG. 18-21, whereby the toolstring 10 with the setting tool 18 is not pulled away at this stage.

Figure 12:
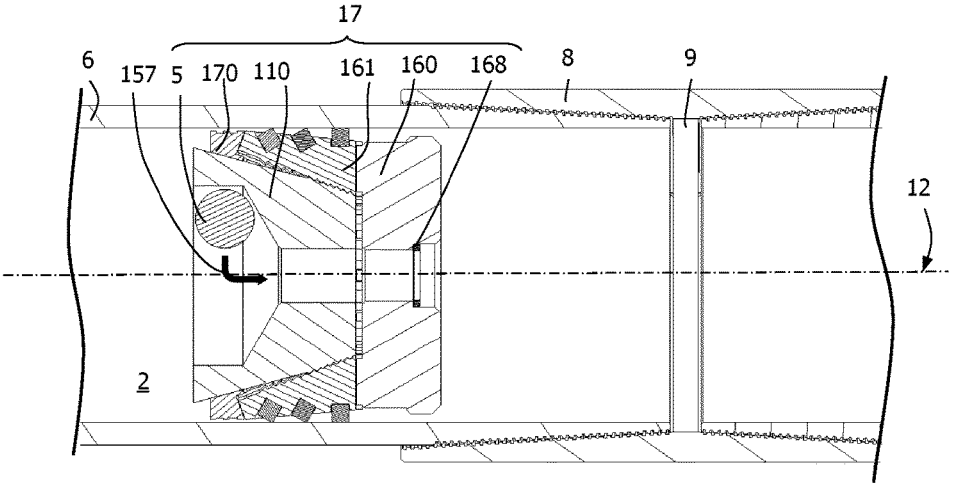
FIG. 12 is a cross-section view of the plug in its radial stopping position, sequential of FIG. 11, whereby the untethered object is moving within the plug.

FIG. 12 represents a subsequent step of FIG. 11. After the toolstring 10 has been pulled uphole, the untethered object 5 may fill the hole within the locking ring 110. Typically, the movement 157 of the untethered object will be initiated through the pumping of well fluid 2. The flow of the well fluid 2 would carry the untethered object 5, up to a stopping position within the locking ring 110. In case of the presence of a flapper valve, as mentioned in FIG. 4, the flapper valve may be closed after the retrieval of the toolstring 10, including the setting tool portion 18 and rod 121. Typically, the flapper valve may include a spring, which may force the flapper valve to reach a closed position, once the rod 121 is retrieved. The closed position of the flapper valve may fit the inner orifice of the locking ring 110.

Figure 13:
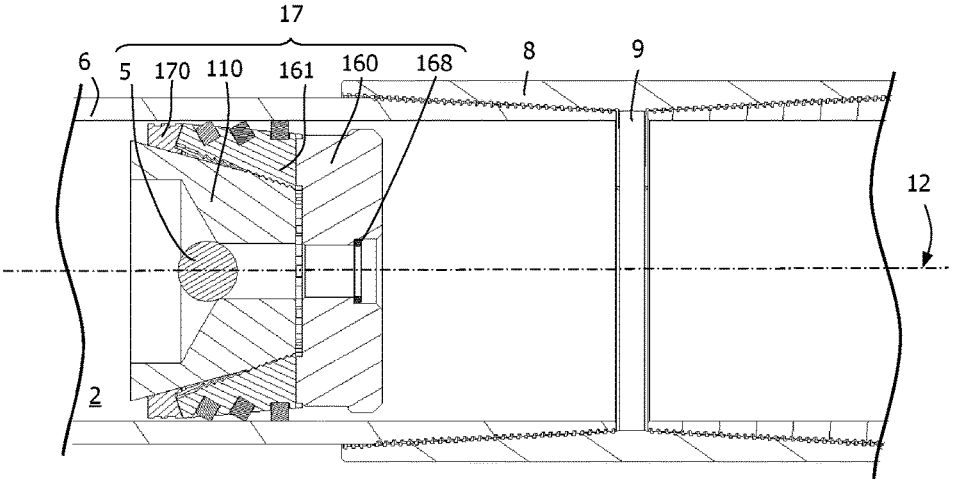
FIG. 13 is a cross-section view of the plug in its radial stopping position, sequential of FIG. 12, whereby the untethered object is seated inside the plug.

FIG. 13 represents a subsequent step of FIG. 12. The untethered object 5 is now stopped within the locking ring 110. With matching shapes between the untethered object 5 and the hole within the locking ring 110, the majority of the flow of the well fluid 2 may now be stopped from circulating inside the plug 17. Example of matching shapes would be a sphere for the untethered object 5, and a cylindrical edge or conical edge for the hole within the locking ring 110.

Figure 14:
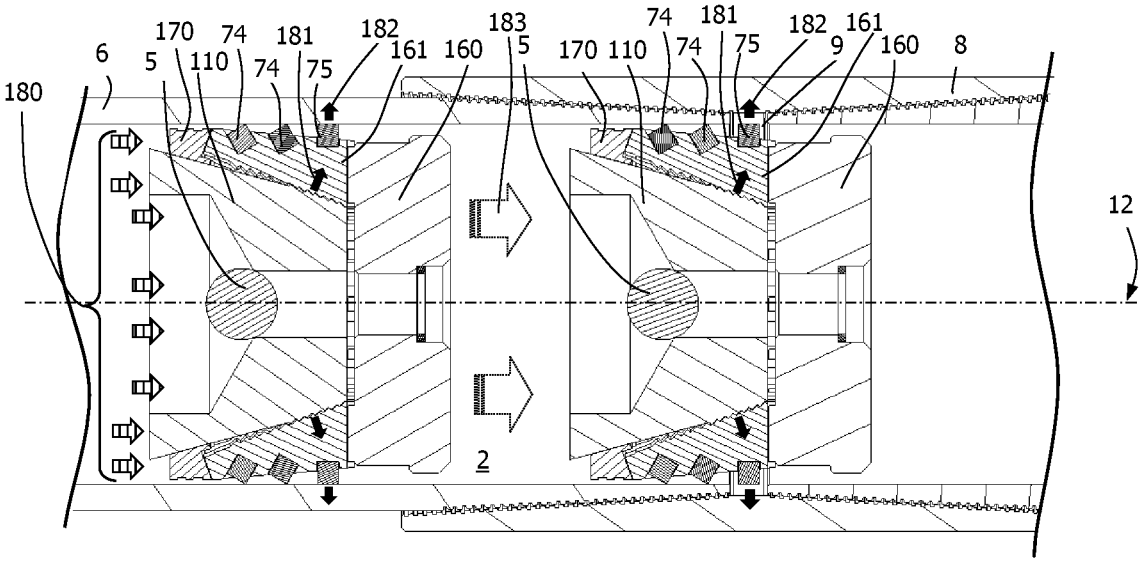
FIG. 14 is a cross-section view of the plug in its radial stopping position, sequential of FIG. 13, whereby the plug has been pumped and moved towards the transition gap inside the tubing string.

FIG. 14 represents a subsequent step of FIG. 13. A flow of well fluid 2 is acting as a downhole pushing force 180 for the actuated plug 17, in its stopping position. The well fluid flow would typically be pumped from surface at a rate in the order of 0.1 to 10 barrel-per-minute [0.016 to 1.6 m3/min]. The flow restriction from the plug 17 would create a localized overpressure and in turn provide a downhole pushing force 180 to the surface contacting the fluid. The downhole pushing force 180 may therefore act as a force on all uphole exposed component of the plug 17, namely the sealing portion 170, the locking ring 110, the untethered object 5. The resulting forces would typically be longitudinal in the direction of the cylindrical axis 12. The force acting in particular on the locking ring 110 may further be transmitted as a force 181 towards the gripping portion 161, through the contact of the surface 113 of the locking ring 110 towards the gripping portion 161. The force 181 may be represented as an arrow 181, symbolizing the radial cylindrical force, acting on the gripping portion 161. Within the locking ring 110, the radial force 181 may be directed towards the protrusion 75 as another radial force 182, acting towards the inner surface of the tubing joint 6. The non-gripping shape of the protrusion 75 would allow the protrusion 75 and the overall gripping portion 161 not to penetrate inside the inner surface of the tubing string 6, and therefore keep a sliding possibility of the protrusion 75 relative to the inner surface of the tubing joint 6. The overall resulting force 180 may be converted to a movement of the plug 17, towards the downhole direction. The movement 183 of the plug 17 is symbolized by arrow 183. During the sliding movement 183 of the plug 17, the protrusion 75 would slide while keeping a radial contact towards the inner surface of the tubing string 6.

The sliding movement 183 would allow the plug 17, in its stopping position, to move towards the next positioned transition gap 9, located between two tubing joints 6. At the position where the protrusion 75 faces radially the transition gap 9, the radial force 182 is still active temporarily and would constraint the protrusion 75 to enter radially towards the transition gap 9.

Figure 15:
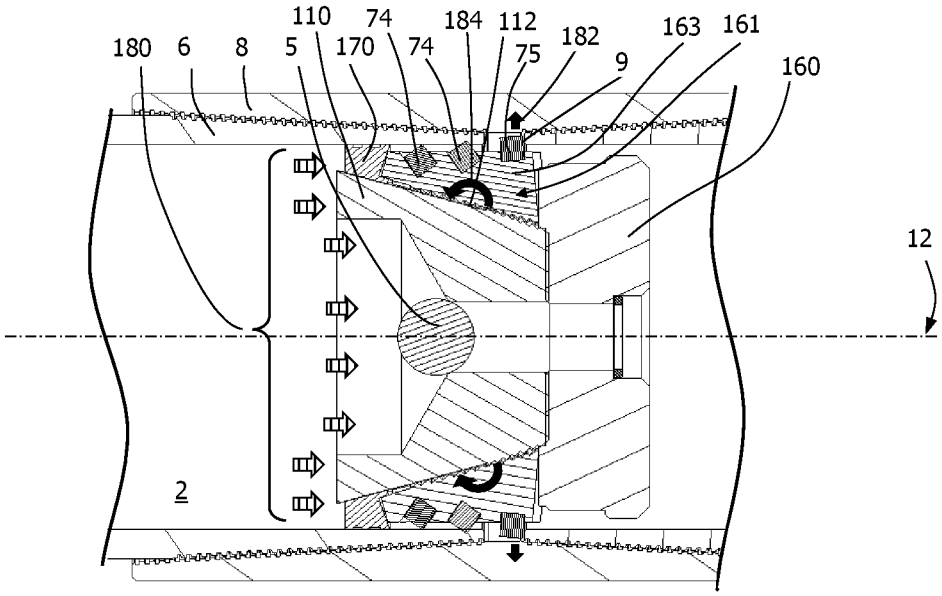
FIG. 15 is a cross-section view of the plug, in front of the transition gap inside the tubing string, sequential of FIG. 14, whereby the bi-stable slips have rotated.

FIG. 15 represents a subsequent step of FIG. 14. The plug 17 and in particular the protrusion 75 of the gripping portion 161 is facing radially the transition gap 9. Each slip 163 of the gripping portion 161 would be forced by the radial force 182 to tilt towards the transition gap 9. Further design details of the individual slips 163 within the gripping portion 161 may be found in FIGS. 24 and 25.

The rotation of each slip 163 would be represented by arrow 184. The rotation of each slip 163 would occur around the transition line 112 of the locking ring 110. The slip 163 passes therefore from a stable position, having its inner surface 162 in contact with the steep outer flared surface 113 of the locking ring 110, to another stable position, having its inner surface 162 in contact with the shallow outer flared surface 111 of the locking ring 110. Each slip 163 may tip up individually in the second bi-stable position, through rotation 184.

Figure 16:
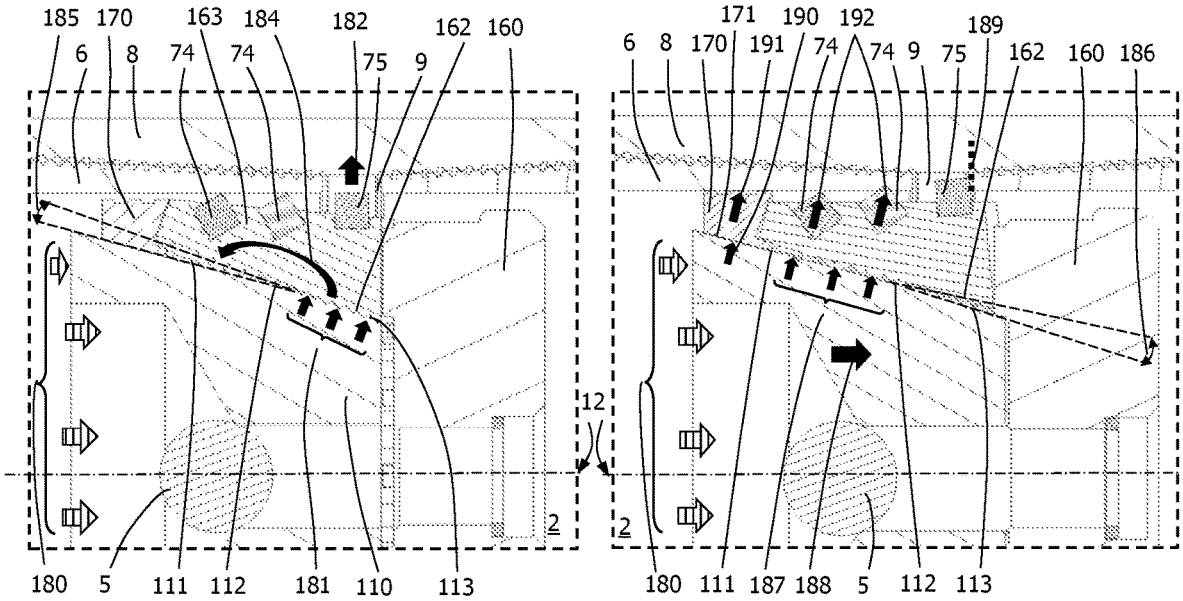
FIG. 16 represents two cross-section close-up view of the plug, in front of the transition gap in the tubing string, with the left view depicting the bi-stable slips before the rotation, and the right view depicting the bi-stable slips after the rotation.

FIG. 16 depicts a detailed view of the two positions for the bi-stable slips 163. The left view represents the slip 163 contacting the surface 113, while the right view represents the slip 163 contacting the surface 111. In more detail, an angle 185 represents the orientation difference between the shallow flared outer surface 111 and steep flared outer surface 113. An angle 186 represents the orientation difference between the steep flared outer surface 113 and the shallow flared outer surface 111. Geometrically, both angles 185 and 186 would have the same angular value and may have a value between 0.5 to 15 degrees.

A contact radial force 187 represents the force transmitted between the shallow flared outer surface 111 of the locking ring 110, and the flared inner surface 162 of the gripping portion 161. With the bi-stable position of each slip 163 of the gripping portion 161, a new force equilibrium is achieved. The protrusion 75 would typically not act any more, other than ensuring the position of each slip 163 with the protrusion 75 being trapped inside the transition gap 9, symbolized as a stop contact 189. The continuing fluid flow force 180, acting on the same plug component, namely sealing portion 170, locking ring 110 and untethered object 5, provides a different radial force diagram with the plug 17. The rotation 184 of the slips 163 of the gripping portion 161, enables a further longitudinal movement 188 of the locking ring 110 compared to its previous position relative to the gripping portion 161. The further longitudinal movement of the locking ring 110 provides an additional expansion force 190 towards the sealing portion 170 contacting the shallow flared outer surface 111 of the locking ring 110. The sealing portion 170 may in turn reach or enhance the contact with the inner surface of the tubing joint 6, through the radial expansion force 191. The contact radial force 187 may be transmitted towards the gripping devices 74 through a radial expansion force 192. The radial force 192 may enable the gripping devices 74 to penetrate and anchor inside the inner surface of the tubing joint 6, and therefore secure the position of the now set plug 17. As the flow pressure 180 increases, typically through reaching higher flowrates and higher pressure, in the typical range of 1,000 to 20,000 psi [69 to 1379 bars], the radial forces 171 and 187 will increase, which in turn enhance the sealing through the radial expansion force 191, and enhance the gripping through the radial expansion force 192.

Figure 17:
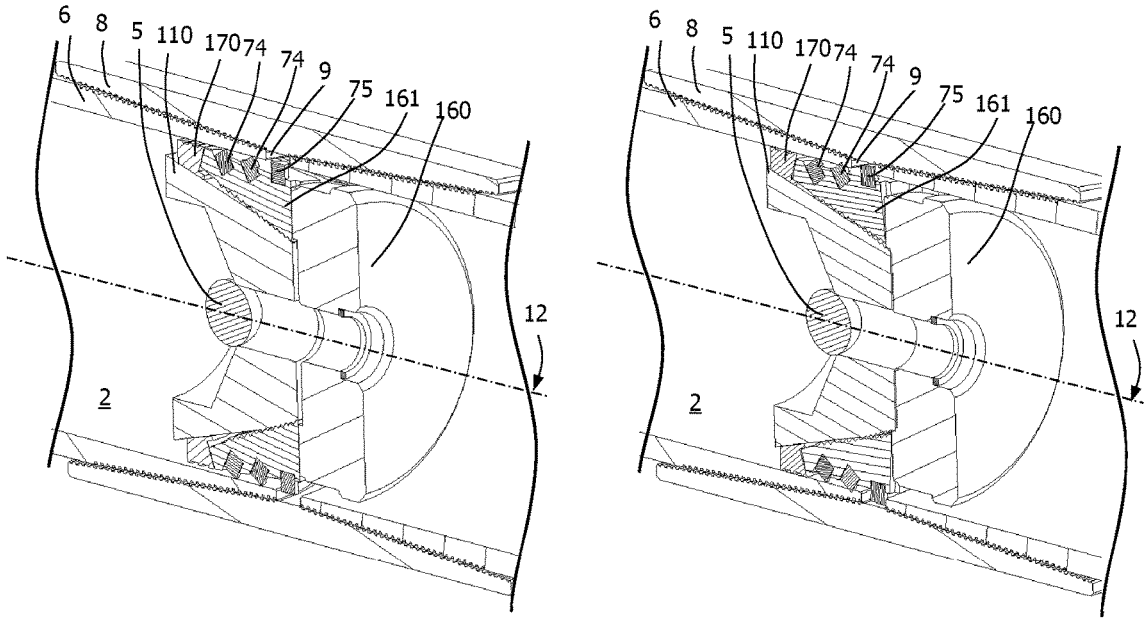
FIG. 17 represents two isometric cross-section views of the plug, in the same configuration as both views of FIG. 16.

FIG. 17 represent the same two embodiments as FIG. 16, depicted as isometric views. As for FIG. 16, the left view depicts the bi-stable slip 163 in the position where the inner surface 162 is in contact with the steep flared outer surface 113 of the locking ring 110. As for FIG. 16, the right view depicts the bi-stable slip 163 in the position where the inner surface 162 is in contact with the shallow flared outer surface 111 of the locking ring 110.

Figure 18:
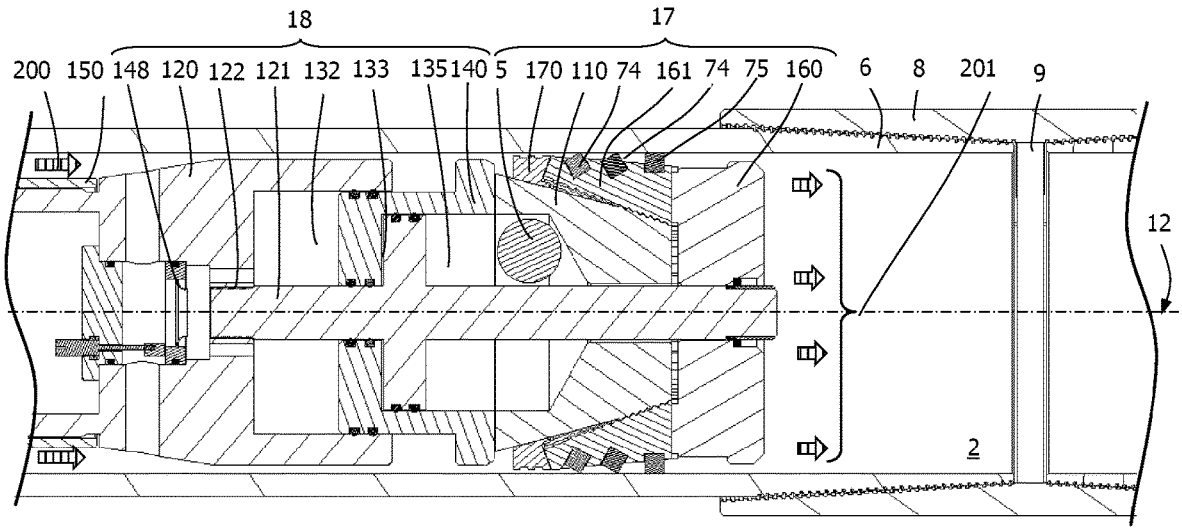
FIG. 18 is a cross-section view of a plug its radial stopping position, pumped on the setting tool towards the transition gap, sequential of FIG. 9 and alternative of FIG. 11.

FIGS. 18 to 21 represent an alternative sequence to FIGS. 11 to 15. Compared to FIG. 11, FIG. 18 represents the plug 17, after actuation and reaching its stopping position, whereby the plug 17 is not released from the setting tool 18, at this point. A well fluid flow force 200 would be generated from the pumping of well fluid 2, typically pumped from surface, in the order of 0.1 to 10 barrel-per-minute [0.016 to 1.6 m3/min]. Well fluid flow force 200 would be acting on the entire toolstring 10 including the fluid-activated setting tool 18 and the actuated plug 17. A longitudinal movement 201 of the entire toolstring would occur relative to the tubing joint 6. While the longitudinal movement 201 is occurring, the protrusion 75 would be in contact with the inner surface of the tubing joint 6. The contact of the protrusion 75 with the tubing joint 6 would be a sliding contact, allowing the sliding of the entire plug 17 along with the toolstring 10 including the setting tool 18. Possible contact friction would be overcome by the longitudinal movement 201 initiated by the well fluid force 200, from the pumping.

Figure 19:
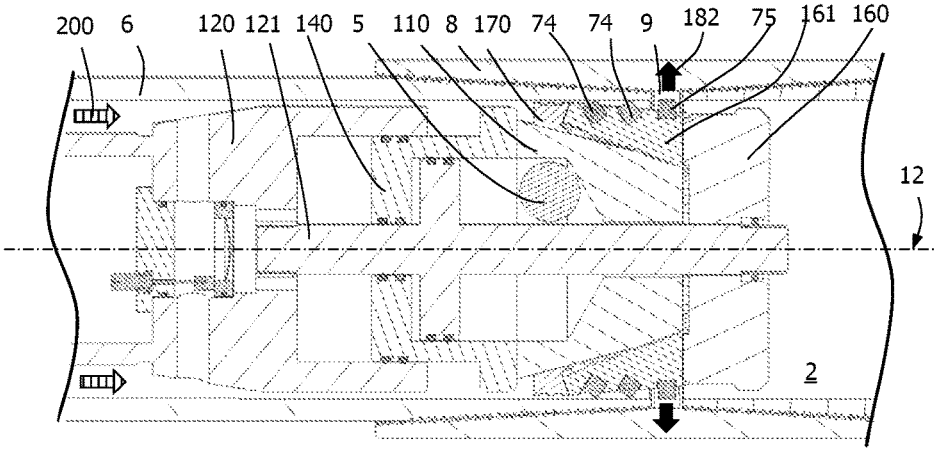
FIG. 19 is a cross-section view of a plug its radial stopping position, pumped on the setting tool in front of the transition gap, sequential of FIG. 18.

FIG. 19 represents a subsequent step compared to FIG. 18. The overall toolstring 10 with the plug 17 in its stopping position has moved longitudinally downhole compared to the tubing joint 6. The sliding of the protrusion 75 inside the inner surface of the tubing joint 6 would occur up to the radial position of the protrusion 75 in front of the transition gap 9. With the protrusion 75 in front of the transition gap 9, a force 182 would represent the radial penetration of the protrusion 75 inside the transition gap 9, as the protrusion 75 is more supported from the sliding friction with the inner wall surface of the tubing joint 6.

Figure 20:
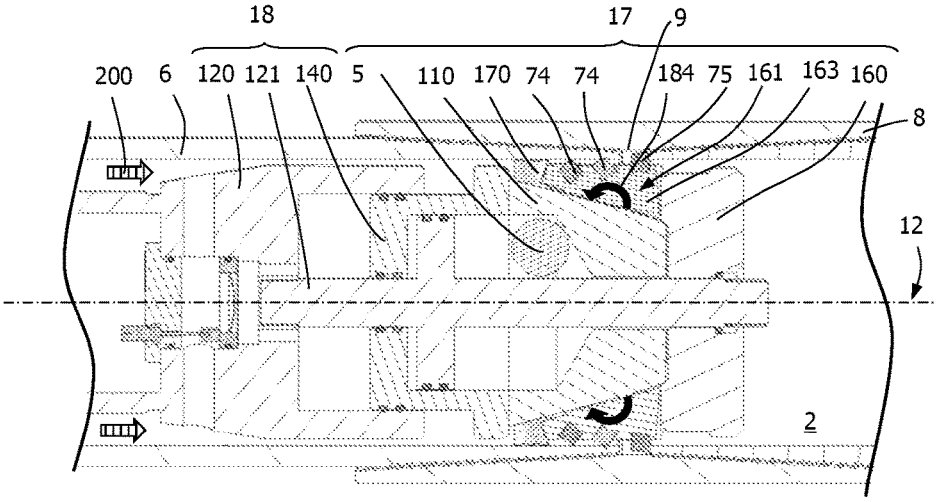
FIG. 20 is a cross-section view of the plug, on the setting tool, in front of the transition gap, sequential of FIG. 19, whereby the bi-stable slips rotate.

FIG. 20 represents a subsequent step compared to FIG. 19. The protrusion 75 is radially moving inside the transition gap 9, allowing each slip 163 to rotate through movement 184. The details of the movement of the slips 163, as bi-stable slips, would be similar to the description done in FIG. 15.

Figure 21:
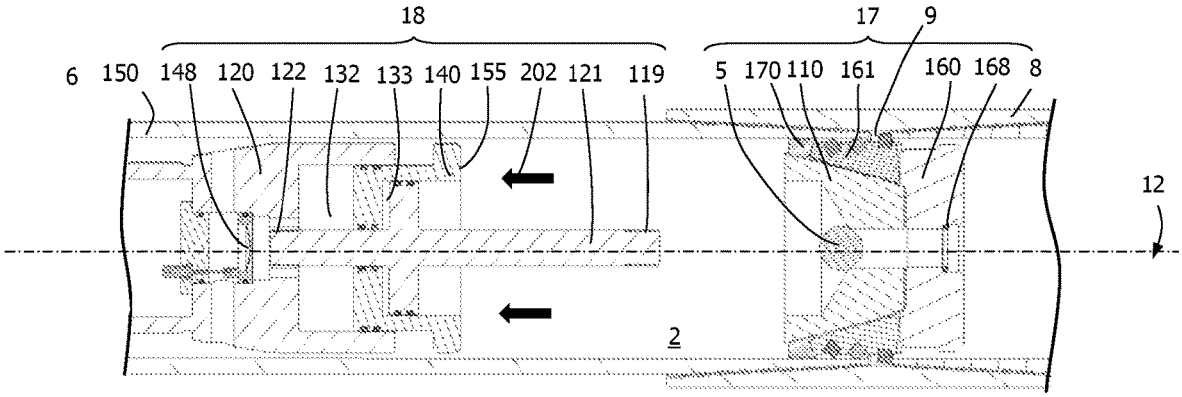
FIG. 21 is a cross-section view of the plug, set inside the transition gap, sequential of FIG. 20, whereby the setting tool is pulled out and the untethered object stopped on the set plug.

FIG. 21 represents a subsequent step compared to FIG. 20. After each slip 163 has rotate and the protrusion 75 locked within the transition gap 9, the toolstring 10 with the setting tool 18 can be retrieved, being pulled uphole depending on various conveyance method, as represented with movement 202. The plug 17 would be released at the position where the protrusion 75 has been locked within the transition gap 9. Subsequent, the untethered object 5 would move to the set position inside the plug, typically within the locking ring 110, through pumping of well fluid 2. The plug would then be fully set after the pumping of further well fluid 2, as already depicted in FIG. 16 and FIG. 17.

Figure 22:
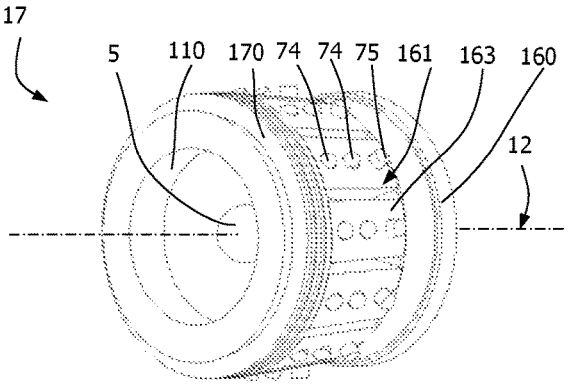
FIG. 22 is an isometric view of a plug in a set position with the untethered object stopped inside the plug.

FIG. 22 represents an isometric view of a set plug 17, as would be depicted as a cross-section in FIG. 16, FIG. 17 and FIG. 21. As represented around the cylindrical axis 12, the plug 17 may include a locking ring 110, a sealing portion 170, a gripping portion 161, a back-pushing ring 160 and an untethered object 5. The gripping portion 161 may include several slips 163 disposed radially around the cylindrical axis 12. Each slip 163 may include one or more anchoring device 74, as well as one or more protrusion 75.

Figure 23:
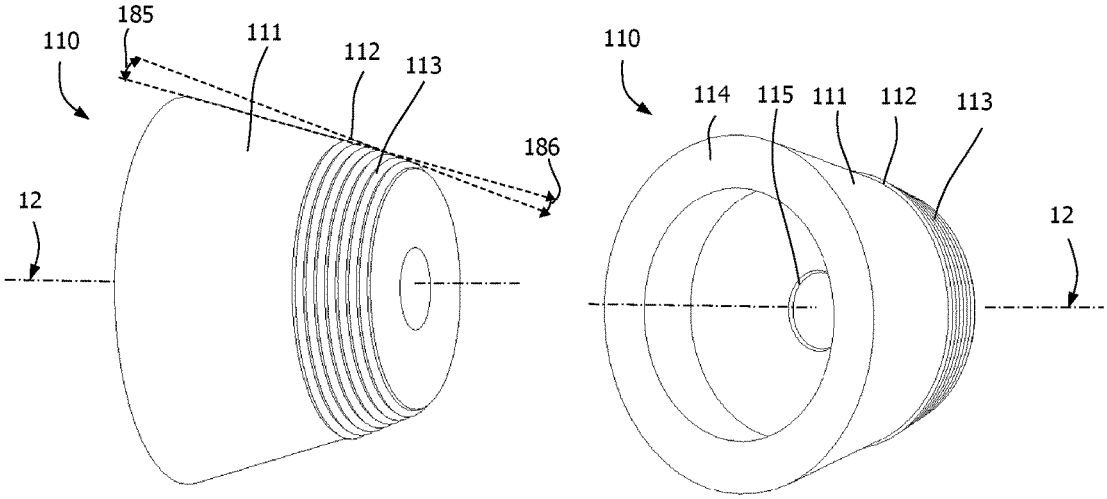
FIG. 23 represents two isometric views of the locking ring, depicted from two different orientations.

FIG. 23 represents two isolated isometric views of the locking ring 110. As previously described in FIG. 10 and further in FIG. 16, the locking ring 110 may include steep flared outer surface 113, followed by a shallowed flared outer surface 111. A transition line 112 symbolizes the transition between the two surfaces 113 and 111. The two surfaces 113 and 111 may include a main conical shape, which may have a conical angle related to the axis 12. The angular difference between the flared outer surface 111 as a cone and the flared outer surface 113 as another cone would be represented as angle 185 or 186. As described in FIG. 16, the angle 185 or 186 may a value between 0.5 to 15 degrees. An internal surface 115 may be used to stop the untethered object 5 once launched inside the plug 17. The surface 115 may a chamfer from a conical to cylindrical connection.

Figure 24:
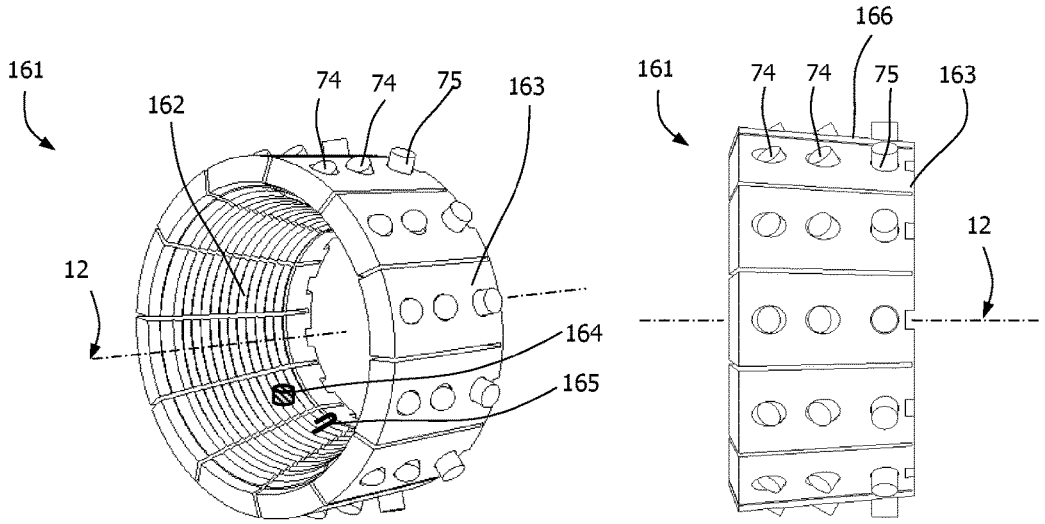
FIG. 24 represents two isometric views of a gripping section, depicted from two different orientations.

FIG. 24 represents two isolated isometric views of the gripping portion 161, in its unexpanded or run-in-hole position. A plurality of slips 163 may be part of the gripping portion 161. Typically, the gripping portion 161 may include from four to twenty four slips 163. The slips 163 may be held separately before the radial expansion or attached together and sheared from each other after the radial expansion during the plug setting process. The radial expansion occurs during the actuation process using the back-pushing ring 160 to longitudinally push the gripping portion 161 over the flared outer surface, primarily surface 113, of the locking ring 110. At the end of radial expansion, the inner surface 162 of each separate slips 163 may be in contact with the outer flared surface 113 of the locking ring.

An internal gripping device 164 may be present on the inner surface 162 of the gripping portion 161. The internal gripping device 164 could have the form of a button or of a protrusion to enhance the friction of the inner surface 162 of each separate slip 163 relative to the flared outer surface 113 of the locking ring 110. The internal gripping device 164 could be placed at multiple positions within the inner flared surface 162 of the gripping portion 161.

An internal spring 165 may also be present on the inner surface 162 of the gripping portion 161. The internal spring 165 could be used to provide a radial pushing force from the inner surface 162 of each separate slip 163 relative to the flared outer surface 113 of the locking ring 110. The internal spring 165 could enhance the rotation movement 184 of each slip 163 during the tilting of the bi-stable position.

The slips 163 may have a flared out surface 166, such as conical. The flared out surface 166 may have an angle between 0.5 to 15 degree compared to the axis 12. Typically, the flared out surface 166 may have the same angle value as the angle 185 or 186, as for the locking ring 110, shown in FIG. 23. Therefore, each slip 163 may have its inner surface 162 contacting the surface 113 of the locking ring 110, and keep a flared out surface 166 with an angle relative to the axis 12. And at the event of the rotation of each slip 163 as bi-stable slips, whereby the contact surface between the inner surface 162 and the steep flared outer surface 113 is moving to contact the shallow outer surface 111, the outer surface 166 of each slips may be close to aligned with the axis 12, and therefore with the cylindrical inner surface of the tubing string 6.

Figure 25:
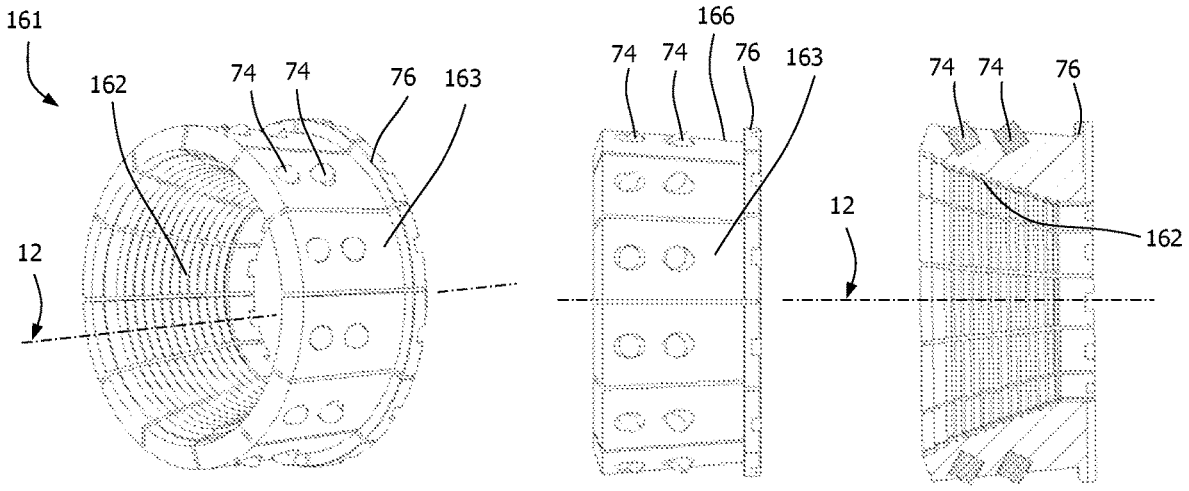
FIG. 25 represents two isometric views and a cross-section view of a gripping section, as an alternate embodiment compared to FIG. 24.

FIG. 25 represents two isolated isometric view and a cross-section view of the gripping portion 161. FIG. 25 depicts a variation compared of the gripping portion 161 compared to FIG. 24. The visible difference between the gripping portion 161 of FIG. 25 compared to FIG. 24 is the shape of a protrusion 76. The protrusion 76 would have the same function as the protrusion 75. The protrusion 76 would be an integral part of each slips 163.

FIGS. 26 to 29 represents an alternative sequence for setting a plug 19 with a fluid activated setting tool 18. The plug 19 may not include bi-stable slips as represented in FIGS. 4-25. The plug 19 may include a locking ring 109, a sealing portion 170, a gripping portion 159, a back-pushing ring 160 and a shearing device 166. In addition, an untethered object 5 may be carried within the plug 19. The locking ring 109 may only include one flared outer surface, which may be one difference compared to the looking ring 110 adapted for bi-stable slips. The gripping portion 159 may have anchoring devices and may not have a protrusion, as would the gripping portion 161 for the bi-stable slips.

Figure 26:
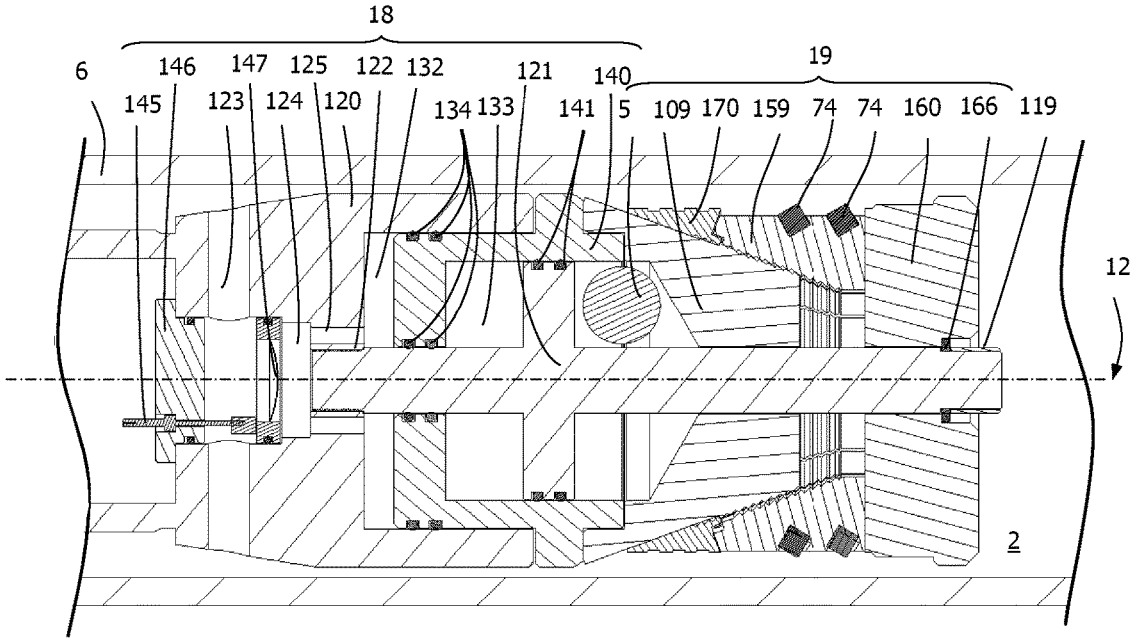
FIG. 26 is a cross-section view of a plug with a fluid actuated setting tool inside a tubing string, as an alternative to FIG. 4, whereby the plug does not include bi-stable slips.

FIG. 26 represents the plug 19 on the fluid activated shifting tool 18, in the unactuated or run-in-hole position. The components of the fluid activated shifting tool 18 are the same as described in FIGS. 4 to 21.

Figure 27:
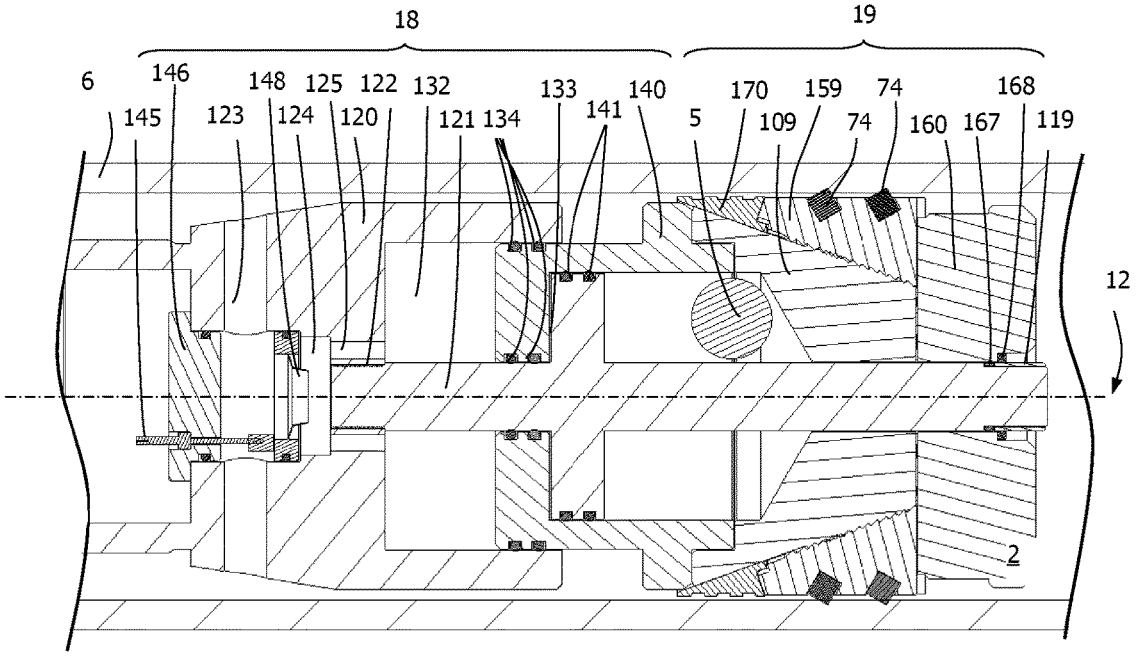
FIG. 27 is a cross-section view of plug actuated with a fluid actuated setting tool inside a tubing string, sequential of FIG. 26.

FIG. 27 represents the plug 19 actuated by the fluid activated shifting tool 18. The shearing device 166 may have been sheared in two portions, 167 contacting the rod 121 and 168 contacting the back-pushing ring 160. The mechanism of actuation and shearing of the shearing device 166 may be the same as described in FIGS. 7-9. The difference for the plug 19, compared to the plug 17 described in FIGS. 4-21, may be the penetration of the anchoring device 74 within the inner surface of the tubing joint 6. The fluid activated shifting tool 18 may provide sufficient force to allow the penetrating of the anchoring devices 74.

Figure 28:
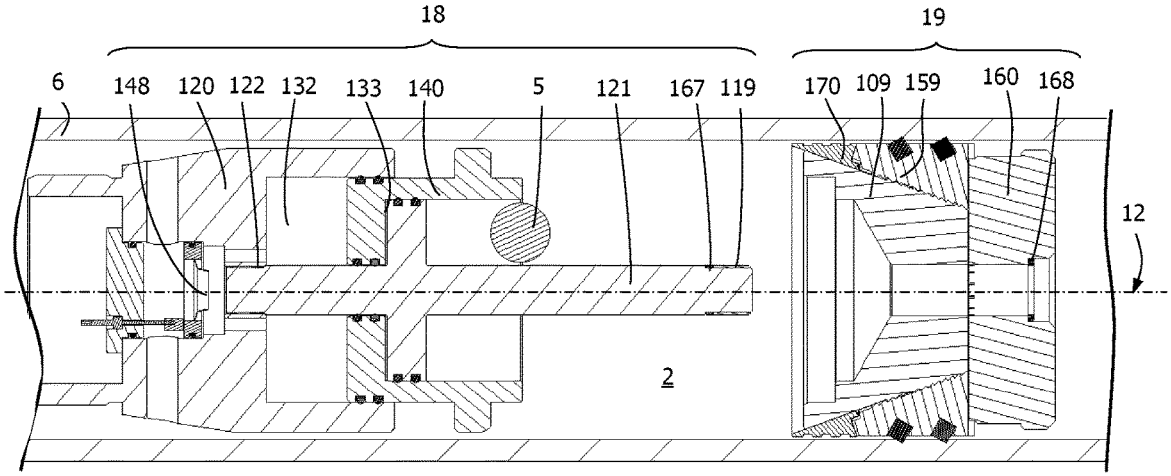
FIG. 28 is a cross-section view of the actuated and set plug, sequential of FIG. 27, whereby the fluid actuated setting tool is pulled away from the set plug.

FIG. 28 represents a subsequent step of FIG. 27, whereby the toolstring 10 with the fluid activated shifting tool 18 may have been retrieved and pulled away from the set plug 19. The plug 19 may be set within the tubing string 6, and the untethered object free to flow towards the inner surface of the locking ring 109.

Figure 29:
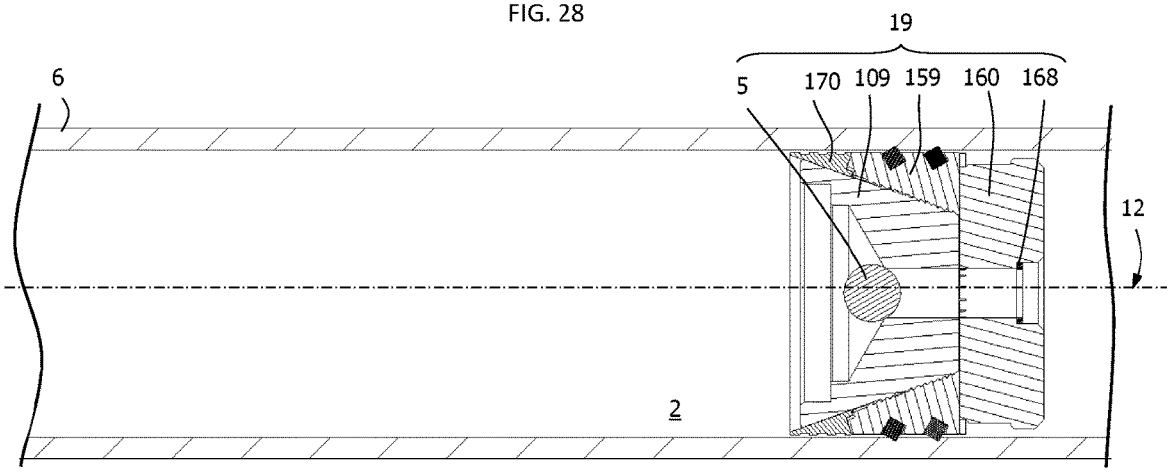
FIG. 29 is a cross-section view of the set plug inside a tubing string, sequential of FIG. 28, whereby the untethered object has landed and stopped on the set plug.

FIG. 29 represents a subsequent step of FIG. 28, whereby the untethered object 5 has landed on the set plug 19. With the pumping of well fluid 2 from surface, the set plug 19 might transmit an fluid force from the untethered object 5, towards the locking ring 109, and in turn towards the sealing portion 170 and gripping portion 159. The sealing portion 170 may continue to be radially expanded due to the contact with the flared outer surface of the locking ring, and therefore the sealing portion 170 may continue to enhance the sealing contact with the inner surface of the tubing string. The gripping portion 159 may continue to be radially expanded due to the contact with the flared outer surface of the locking ring, and therefore the gripping portion 159 may continue to enhance the anchoring contact with the inner surface of the tubing string.

Figure 30:
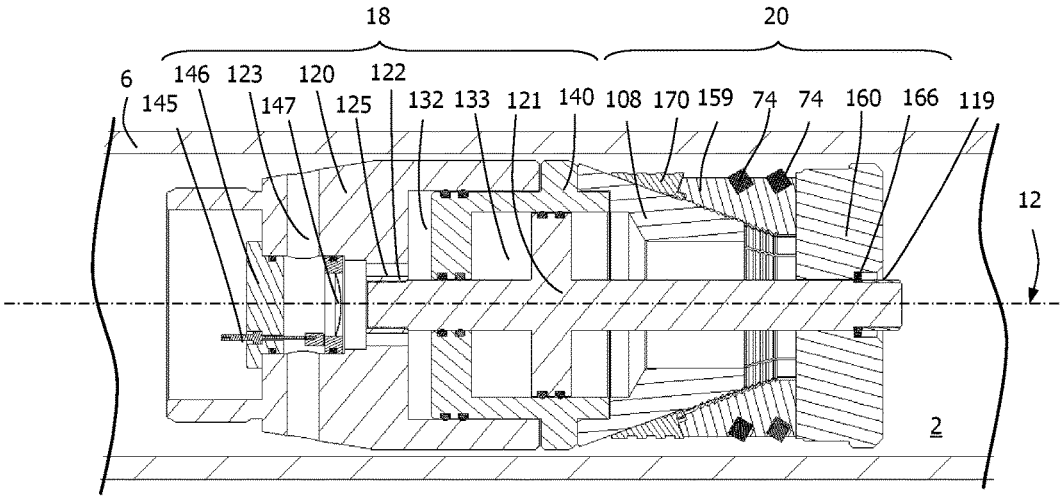
FIG. 30 is a cross-section view of a plug with a fluid actuated setting tool inside a tubing string, as an alternative to FIG. 4 and to FIG. 26, whereby the plug does not include bi-stable slips, and does not include a carried-over untethered object.
Figure 31:
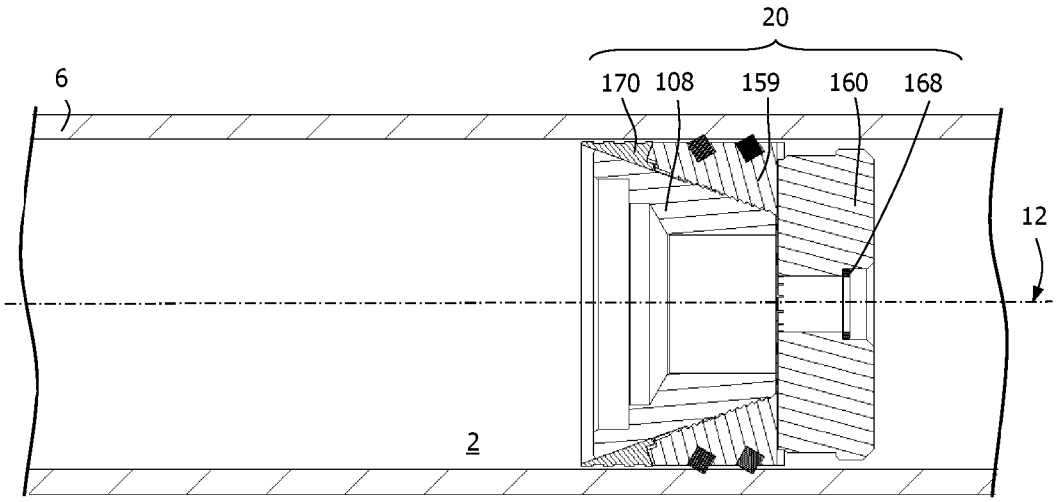
FIG. 31 is a cross-section view of a set plug, inside a tubing string, sequential to FIG. 30.
Figure 32:
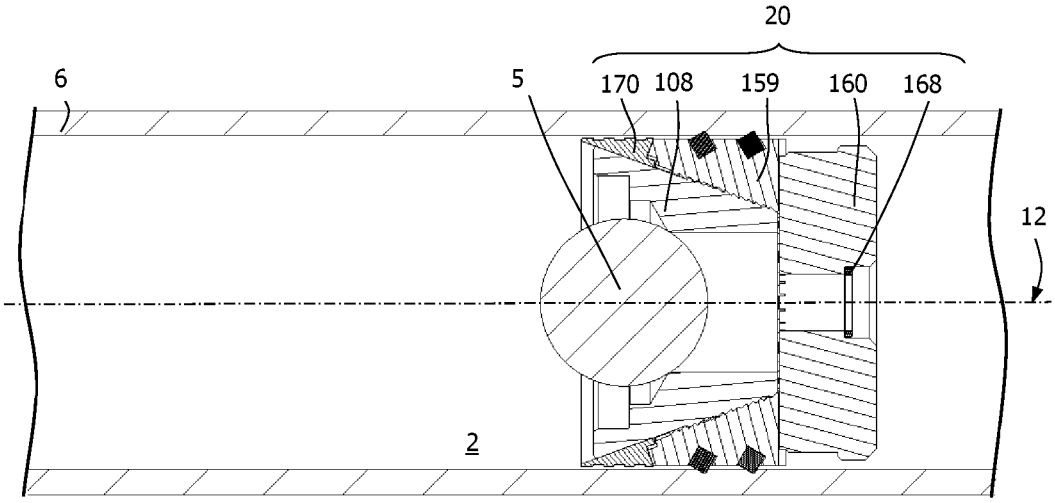
FIG. 32 is a cross-section view of a set plug, inside a tubing string, sequential to FIG. 31, whereby an untethered object has been pumped from surface and landed on the set plug.

FIGS. 30 to 32 represents an alternative sequence for setting a plug 20 with a fluid activated setting tool 18. The difference compared to FIGS. 26-29 would be the position of the untethered object 5. The description of FIGS. 26-29 would include the untethered object 5 as carried within the plug 19 and released after the pull-out of the toolstring 10. In FIGS. 30 to 32, the untethered object 5 would be released from surface, and pumped down with well fluid 2, after the retrieval of the toolstring 10 including the fluid actuated shifting setting tool 18.

FIG. 30 represents the plug 20 on the fluid activated shifting tool 18, in the unactuated or run-in-hole position. The components of the fluid activated shifting tool 18 are the same as described in FIGS. 4 to 21. The plug 20 includes a locking ring 108 with an inner surface which allows to land an untethered object 5 launched from surface.

FIG. 31 represents the plug 20 actuated and set within the tubing string 6, and the toolstring 10 including the fluid activated shifting setting tool 18 retrieved and back to surface.

FIG. 32 represents the plug 20 with the untethered object 5 landed on the inner surface of the locking ring 108, after being pumped from surface with well fluid 2.

Figure 33:
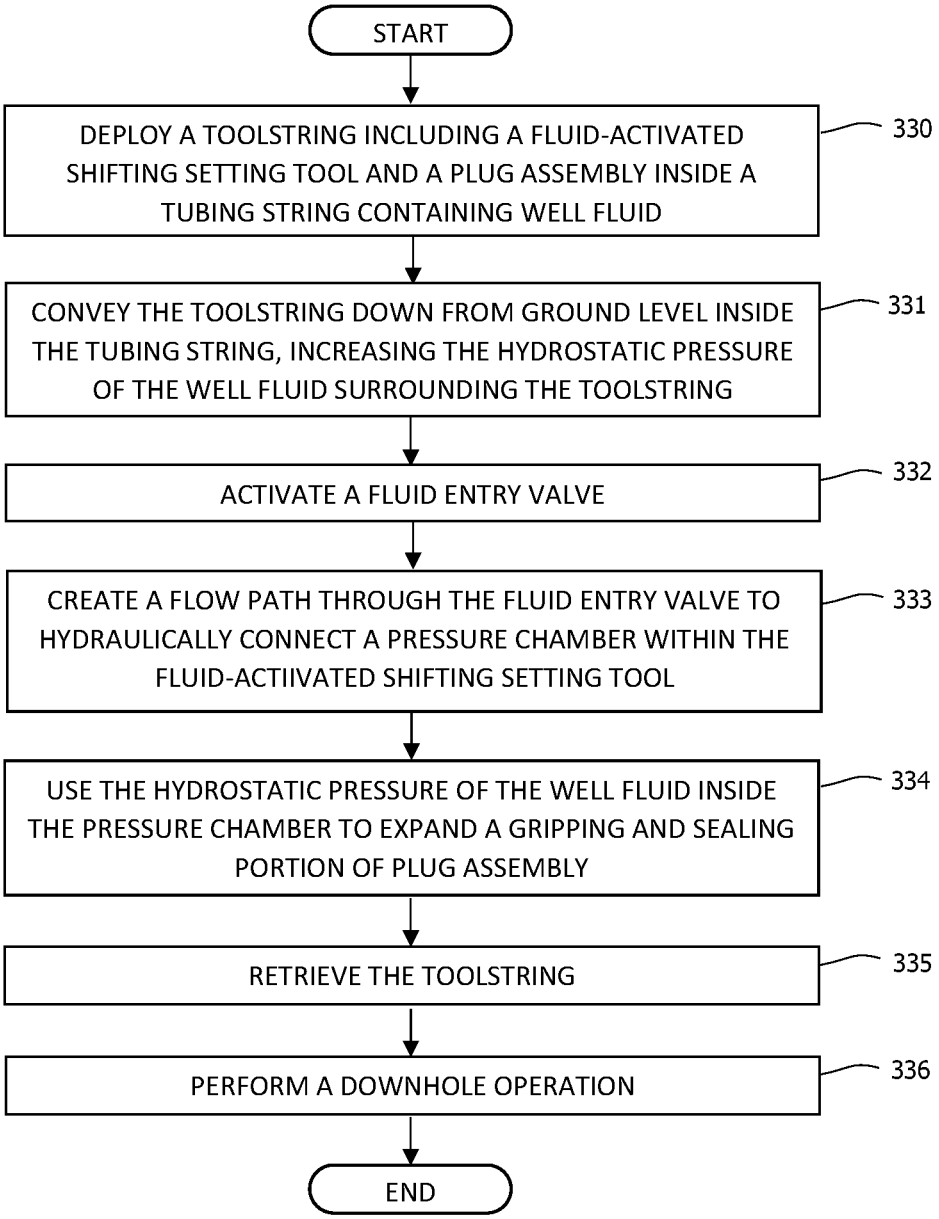
FIG. 33 is a workflow sequence, representing the setting of a plug with a fluid activated setting tool

FIG. 33 represents a workflow sequence related to a fluid activated shifting setting tool. Step 330 comprises the deployment of a toolstring including a fluid-activated shifting setting tool and a plug assembly inside a tubing string containing well fluid. Step 331 comprises the conveyance of the toolstring down from ground level inside the tubing string, whereby the hydrostatic pressure of the well fluid surrounding the toolstring. Step 332 comprises the actuation of a fluid entry valve. Step 333 comprises the creation of a flow path though the fluid entry valve in order to connect hydraulically a pressure chamber within the fluid-activated shifting setting tool. Step 334 comprises the use of the hydrostatic pressure of the well fluid inside the pressure chamber to expand a gripping and sealing portion of the plug assembly. Step 335 comprises the retrieval of the toolstring. Step 336 comprises the performance of a downhole operation.

Figure 34:
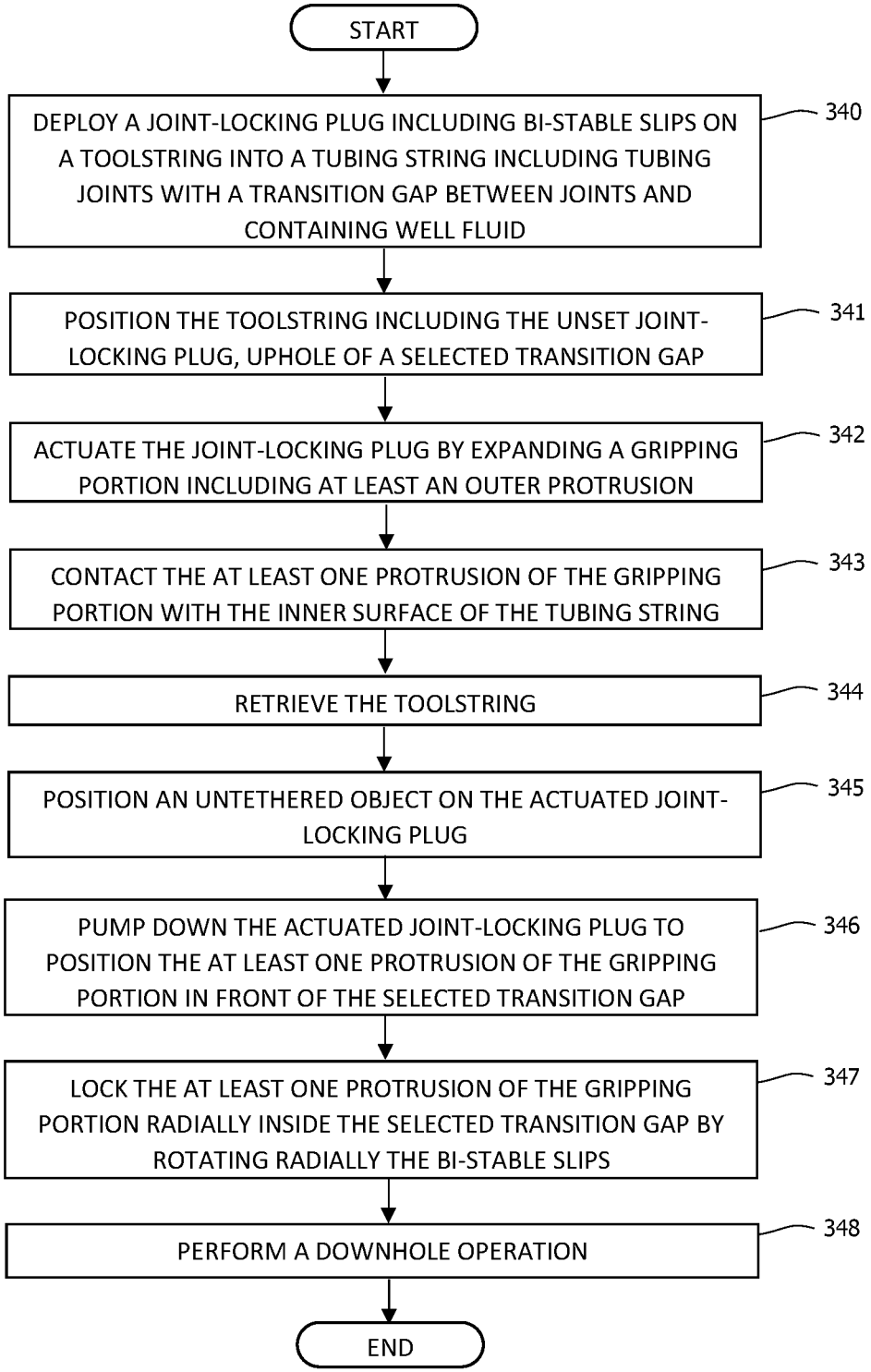
FIG. 34 is a workflow sequence, representing the actuation and setting of a joint-locking plug including bi-stable slips, in front of a transition gap.

FIG. 34 represents a workflow sequence related to the actuation of joint-locking plug including bi-stables slips. Step 340 comprises the deployment of a joint-locking plug including bi-stable slips on a toolstring into a tubing string including tubing joints with a transition gap between joints and containing well fluid. Step 341 comprises the positioning of the toolstring including the unset joint-locking plug, uphole of a selected transition gap. Step 342 comprises the actuation of the joint-locking plug by expanding a gripping position including at least an outer protrusion. Step 343 comprises the contact of the at least one protrusion of the gripping position with the inner surface of the tubing string. Step 344 comprises the retrieval of the toolstring. Step 345 comprises the positioning of an untethered object on the actuated joint locking plug. Step 346 comprises the pumping down of the actuated joint-locking plug to position the at least one protrusion of the gripping position in front of the selected transition gap. Step 347 comprises locking the at least one protrusion of the gripping portion radially inside the selected transition gap by rotating radially the bi-stable slips. Step 348 comprises the performance of a downhole operation.

Figure 35:
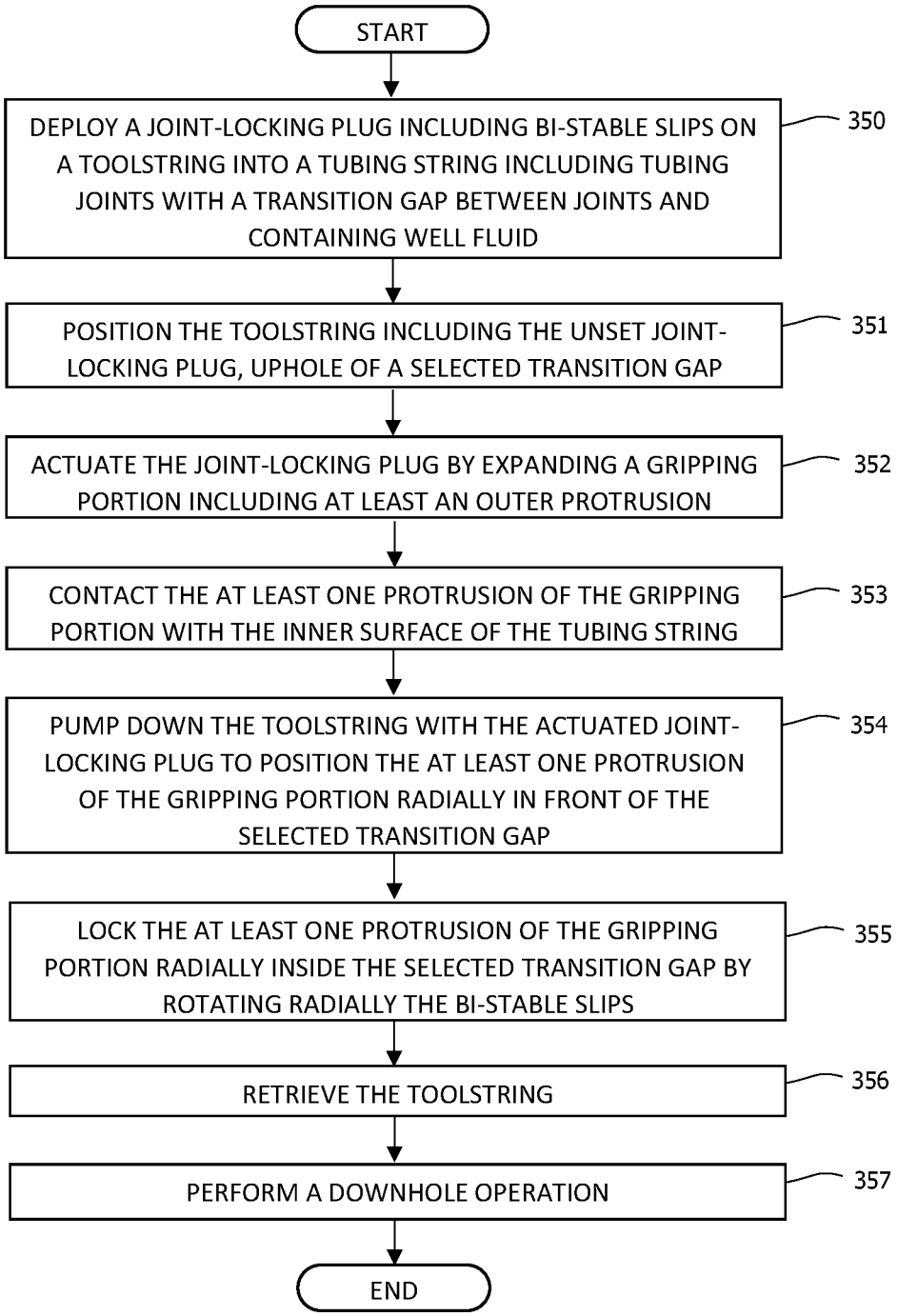
FIG. 35 is a workflow sequence, representing the actuation and setting of a joint-locking plug including bi-stable slips, in front of a transition gap, as an alternate to FIG. 34.

FIG. 35 represents a workflow sequence related to the actuation of joint-locking plug including bi-stables slips. Step 350 comprises the deployment of a joint-locking plug including bi-stable slips on a toolstring into a tubing string including tubing joints with a transition gap between joints and containing well fluid. Step 351 comprises the positioning of the toolstring including the unset joint-locking plug, uphole of a selected transition gap. Step 352 comprises the actuation of the joint-locking plug by expanding a gripping position including at least an outer protrusion. Step 353 comprises the contact of the at least one protrusion of the gripping position with the inner surface of the tubing string.

Step 354 comprises the pumping down of the toolstring with the actuated joint-locking plug to position the at least one protrusion of the gripping position in front of the selected transition gap. Step 355 comprises locking the at least one protrusion of the gripping portion radially inside the selected transition gap by rotating radially the bi-stable slips. Step 356 comprises the retrieval of the toolstring. Step 357 comprises the performance of a downhole operation.

What is claimed is:

1. A method comprising:

deploying downhole a joint-locking plug, on a toolstring, into a tubing string including multiple tubing joints and containing well fluid, the joint-locking plug including:

a cylindrical axis, whereby the cylindrical axis is a virtual axis of revolution for the joint-locking plug, an expandable gripping portion, whereby the expandable gripping portion includes at least one radial protrusion whereby the tubing joints are connected longitudinally to each other's while keeping a joint transition gap at the connection, the joint transition gap being positioned radially on the inner surface of the tubing string;

positioning the toolstring, including the joint-locking plug, uphole of a selected joint transition gap;

actuating the joint-locking plug by expanding the expandable gripping portion and contacting the at least one radial protrusion with the inner surface of the tubing string, uphole of the selected joint transition gap;

retrieving the toolstring, keeping the joint-locking plug with expanded gripping portion, uphole of the selected joint transition gap;

positioning an untethered object on the joint-locking plug or closing a flapper valve on the joint-locking plug;

pumping down the joint-locking plug together with the untethered object or the closed flapper valve, up to the position where the at least one radial protrusion of the gripping portion is facing radially the selected joint transition gap;

locking the at least one radial protrusion of the gripping portion radially inside the selected joint transition gap, so that the joint-locking plug is stopped from moving longitudinally downhole within the tubing string.

2. The method of claim 1, wherein the expandable gripping portion includes separate slips, the separate slips including:

a protrusion section and an anchoring section on their outer face, wherein the protrusion section includes the at least one protrusion of the expandable gripping portion;

wherein the anchoring section is positioned longitudinally uphole compared to the protrusion section;

an inner surface, whereby the inner surface is flared, such as conical, spherical or combination thereof;

whereby the inner surface comprises one average conical leading angle, relative to the cylindrical axis of the plug.

3. The method of claim 2, whereby the joint-locking plug further includes a locking ring, the locking ring including:

an outer surface, whereby the outer surface is flared, such as conical, spherical or combination thereof, whereby the outer surface comprises two longitudinally subsequent flared portions, wherein each of the two flared portions is characterized by an average conical leading angle, and wherein a first flared portion is characterized by a shallow conical leading angle and a second flared portion is characterized by a steep conical leading angle, whereby the shallow and steep leading angles have different values relative to the cylindrical axis of the plug, and the angular value difference between the steep and shallow leading angle is between 0.5 and 15 deg, whereby the relative position of the first flared portion is uphole compared to the second flared portion, within the locking ring.

4. The method of claim 3, whereby the average conical leading angle of the inner surface of the slips equals the steep conical leading angle of the locking ring, within a tolerance of plus or minus 2 degrees, and is different from the shallow conical leading angle of the locking ring.

5. The method of claim 4, whereby the slips include a bi-stable position, the bi-stable position including:

a first position whereby the inner surface of the slips is in contact with the steep outer surface of the locking ring a second position whereby the inner surface of the slips is in contact with the shallow outer surface of the locking ring.

6. The method of claim 5, wherein the outer surface of the locking ring includes a longitudinal transition between the shallow portion and steep portion, wherein the transition line represents a pivoting line for the two bi-stable positions of the slips.

7. The method of claim 6, whereby, at the end of actuating the joint-locking plug by expanding the expandable gripping portion, the inner surface of the slips is contacting the steep surface of the locking ring, the protrusion portion of the slips is positioned radially downhole of the transition line of the locking ring.

8. The method of claim 3, whereby the joint-locking plug further comprises a sealing portion, wherein the sealing portion is radially expanded during the joint-locking plug actuation together with the expansion of the expandable gripping portion over the flared outer surface of the locking ring to an outer diameter which is less than the tubing string inner diameter, wherein the sealing portion is further expanded radially after locking the at least one radial protrusion of the gripping portion inside the selected joint transition gap, using the pumping down of well fluid, applied to the joint-locking plug together with the untethered object.

9. The method of claim 1, whereby positioning the untethered object occurs from either pumping from surface or directly releasing from the toolstring.

10. The method of claim 1, further dissolving at least one component of the plug or the untethered object.

11. The method of claim 1, further comprising diverting or blocking a portion of the well fluid inside the tubing string, across the joint-locking plug with the untethered object.

12. The method of claim 1, wherein the expandable gripping portion includes separate slips, the separate slips including:

a protrusion section and an anchoring section on their outer face, wherein the protrusion section includes the at least one protrusion of the expandable gripping portion, wherein the anchoring section is positioned longitudinally uphole compared to the protrusion section;

an inner surface, whereby the inner surface is flared, such as conical, spherical or combination thereof, whereby the inner surface comprises two longitudinally subsequent flared portions, wherein each of the two flared portions is characterized by an average conical leading angle, and wherein a first flared portion is characterized by a steep conical leading angle and a second flared portion is characterized by a shallow conical leading angle, whereby the steep and shallow leading angles have different values relative to the cylindrical axis of the plug, and the angular value difference between the steep and shallow leading angle is between 0.5 and 15 deg, whereby the relative position of the first flared portion is uphole compared to the second flared portion, within the slips;

wherein the joint-locking plug further includes a locking ring, the locking ring including:

an outer surface, whereby the outer surface is flared, such as conical, spherical or combination thereof, whereby the outer surface comprises one average conical leading angle, relative to the cylindrical axis of the plug, whereby the average conical leading angle of the outer surface of the locking ring equals the shallow conical leading angle of the inner surface of the slips, within a tolerance of plus or minus 2 degrees, and is different from the steep conical leading angle of the inner surface the slips.

13. A method comprising:

deploying downhole a joint-locking plug on a toolstring into a tubing string including multiple tubing joints and containing well fluid, the joint-locking plug including:

a cylindrical axis, whereby the cylindrical axis is a virtual axis of revolution for the joint-locking plug, an expandable gripping portion, whereby the expandable gripping portion includes at least one radial protrusion whereby the tubing joints are connected longitudinally to each other's while keeping a joint transition gap at the connection, the joint transition gap being positioned radially on the inner surface of the tubing string;

positioning the toolstring, including the joint-locking plug, uphole of a selected joint transition gap;

actuating the joint-locking plug by expanding the expandable gripping portion and contacting the at least one radial protrusion with the inner surface of the tubing string, uphole of the selected joint transition gap;

pumping down the joint-locking plug up to the position where the at least one radial protrusion of the gripping portion is facing radially the selected joint transition gap;

locking the at least one radial protrusion of the gripping portion radially inside the selected joint transition gap, so that the joint-locking plug is stopped from moving longitudinally downhole within the tubing string;

retrieving the toolstring, keeping the joint-locking plug locked within the joint transition gap;

positioning an untethered object on the joint-locking plug or closing a flapper valve on the joint-locking plug;

performing a downhole operation.

14. A joint-locking plugging apparatus, for use inside a tubing string including multiple tubing joints and containing well fluid comprising:

a joint transition gap, whereby the joint transition gap is created by connecting the tubing joints longitudinally to each other's and keeping a longitudinal and radial gap between the tubing joints on the inner surface of the tubing string;

a joint-locking plug including:

a cylindrical axis, whereby the cylindrical axis is a virtual axis of revolution for the joint-locking plug;

an expandable gripping portion, including separate slips, wherein the separate slips include a protrusion section and an anchoring section on their outer face, wherein the protrusion section includes at least one protrusion, wherein the anchoring section is positioned longitudinally uphole compared to the protrusion section, wherein the separate slips include an inner surface which is flared, such as conical, spherical or combination thereof, wherein the inner surface of the separate slips comprises one average conical leading angle, relative to the cylindrical axis of the plug;

a locking ring, including an outer surface, whereby the outer surface is flared, such as conical, spherical or combination thereof, whereby the outer surface comprises two longitudinally subsequent flared portions, wherein each of the two flared portions is characterized by an average conical leading angle, and wherein a first flared portion is characterized by a shallow conical leading angle and a second flared portion is characterized by a steep conical leading angle, whereby the shallow and steep leading angles have different values relative to the cylindrical axis of the plug, and the angular value difference between the steep and shallow leading angle is between 0.5 and 15 deg, whereby the relative position of the first flared portion is uphole compared to the second flared portion, within the locking ring, whereby the average conical leading angle of the inner surface of the slips equals the steep conical leading angle of the locking ring, within a tolerance of plus or minus 2 degrees, and is different from the shallow conical leading angle of the locking ring.

15. The apparatus of claim 14, whereby the protrusion of the protrusion section of the slips are shaped to fit longitudinally and radially within the joint transition gap, such as a longitudinal dimension within 0.01 to 10 inch [0.25 to 254 mm] and a radial dimension within 0.01 to 1 inch [0.25 to 25.4 mm].

16. The apparatus of claim 14, whereby the anchoring section of the slips includes teeth or buttons shaped to penetrate the inner surface of the tubing string.

17. The apparatus of claim 14, whereby the inner surface of the slips includes internal buttons, to provide additional internal anchoring between the outer surface of the locking ring and the inner surface of the slips.

18. The apparatus of claim 14, whereby the inner surface of the slips includes internal springs, to provide a radial external force away from the shallow outer surface of the locking ring, and facilitate the transition to contacting the steep outer surface of the locking ring.

* * * * *